US006582051B2

(12) United States Patent
Bruch et al.

(10) Patent No.: US 6,582,051 B2
(45) Date of Patent: Jun. 24, 2003

(54) APPARATUS AND METHOD FOR DETECTING DROPS IN PRINTER DEVICE

(75) Inventors: Xavier Bruch, Sant Cugat del Valles Barcelona (ES); Ramon Vega, Sabadell Barcelona (ES); Antoni S Murcia, San Diego, CA (US); Xavier Alonso, Vilafranca del Penedes Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/113,855

(22) Filed: Mar. 28, 2002

(65) Prior Publication Data

US 2002/0163551 A1 Nov. 7, 2002

(30) Foreign Application Priority Data

Mar. 30, 2001 (EP) ..... 01108126

(51) Int. Cl.[7] ..... B41J 29/393
(52) U.S. Cl. ..... 347/19
(58) Field of Search ..... 347/19, 14, 23, 347/16, 104, 8, 9, 39, 12, 37, 40, 43; 356/402

(56) References Cited

U.S. PATENT DOCUMENTS

| | | | | |
|---|---|---|---|---|
| 4,550,322 A | | 10/1985 | Tamai | 346/75 |
| 4,990,932 A | | 2/1991 | Houston | 346/45 |
| 5,796,414 A | | 8/1998 | Sievert et al. | 347/19 |
| 5,798,773 A | * | 8/1998 | Hiramatsu et al. | 347/19 |
| 5,835,108 A | | 11/1998 | Beauchamp et al. | 347/19 |
| 5,975,674 A | | 11/1999 | Beauchamp et al. | 347/19 |

FOREIGN PATENT DOCUMENTS

| | | |
|---|---|---|
| EP | 0744295 A1 | 11/1996 |
| EP | 0863004 A2 | 9/1998 |
| EP | 0867298 A2 | 9/1998 |
| EP | 0895869 A2 | 2/1999 |
| EP | 1027987 A1 | 8/2000 |
| EP | 1033251 A1 | 9/2000 |
| WO | 89/02826 | 4/1989 |

* cited by examiner

*Primary Examiner*—Craig Hallacher
*Assistant Examiner*—Charles W. Stewart, Jr.

(57) ABSTRACT

An ink jet apparatus comprising a nozzle arranged to eject ink droplets and an edge detector arranged to detect droplets having a first range of trajectories and arranged not to detect droplets having a second range of trajectories, the nozzle being arranged to eject one or more first droplets from each of a plurality of positions known relative to the edge detector, the positions being arranged such that the number of first droplets detected by the edge detector varies in dependence upon the magnitude of a component of the ejection direction of the nozzle, the apparatus being arranged to substantially determine a component of the ejection direction of the nozzle in dependence upon the detection by the edge detector.

30 Claims, 11 Drawing Sheets

PCD

PCD

PCD

PCD

PCD

PCD

PCD

PCD

PCD

APPARATUS AND METHOD FOR DETECTING DROPS IN PRINTER DEVICE

FIELD OF THE INVENTION

The present invention relates to printer devices, and particularly, although not exclusively, to a method and apparatus for detecting faulty nozzles in ink jet devices.

BACKGROUND TO THE INVENTION

It is known to produce paper copies, also known as "hard" copies, of files stored on a host device, eg a computer using a printer device. The print media onto which files may be printed includes paper and clear acetates for use in lectures, seminars and the like.

Referring to FIG. 1 herein, there is illustrated a conventional host device 100, in this case a personal computer, linked to a printer device 120 via a cable 110. Amongst the known methods for printing text or graphics and the like onto a print media such as paper it is known to build up an image on the paper by spraying drops of ink from a plurality of nozzles.

Referring to FIG. 2 herein, there is illustrated schematically part of a prior art printer device comprising an array of printer nozzles 220 arranged into parallel rows. The unit comprising the arrangement of printer nozzles is known herein as a print head 210. In a conventional printer of the type described herein, the print head 210 is constrained to move in a direction 260 with respect to the print media 200 eg a sheet of A4 paper. In addition, the print media 200 is also constrained to move in a further direction 250. Preferably, direction 260 is orthogonal to direction 250.

During a normal print operation, print head 210 is moved into a first position with respect to the print media 200 and a plurality of ink drops 230, 240 are sprayed from a number of printer nozzles 220 contained within print head 210. This process is also known as a print operation. After the completion of a print operation the print head 210 is moved in a direction 260 to a second position and another print operation is performed. In a like manner, the print head is repeatedly moved in a direction 260 across the print media 200 and a print operation performed after each such movement of the print head 210. In practice, modern printers of this type are arranged to carry out such print operations while the print head is in motion, thus obviating the need to move the print head discrete distances between print operations. When the print head 210 reaches an edge of the print media 200, the print media is moved a short distance in a direction 250, parallel to a main length of the print media 200, and further print operations are performed. By repetition of this process, a complete printed page may be produced in an incremental manner.

In order to maintain the quality of the printed output of the printer device, it is important that each instruction to the print head to produce an ink drop from a given nozzle does indeed produce such an ink drop. It is also important that each drop that is ejected from the print head is correctly positioned on the print media.

In conventional printers it is known to attempt to detect an ink drop as it leaves a nozzle of the print head during nozzle testing routines. In this manner, if no ink drop is detected in response to a signal to eject an ink drop, the nozzle concerned may be assumed to be malfunctioning and appropriate maintenance routines may be implemented. An example of this type of drop detection system is disclosed in European Patent Application No.1027987, in the name of Hewlett-Packard Company.

In such systems, the drop detection unit employs an LED and lens to produce a collimated beam of light. The collimated beam of light is arranged to be incident on a photo diode, which generates an electrical current in response to the incident light. Prior to testing nozzles of a print head, the print head is positioned in a testing position, generally outside of the region used for printing onto the print media. An ink drop is then sprayed from a selected nozzle of the print head through the collimated beam of light. As the ink drop passes through the light beam, it partially blocks light normally incident on the photo diode. Due to the decrease in light incident on the photo diode, the current which it generates decreases temporarily. The change in the output current of photo diode is detected and forms the basis for an ink drop detection signal which is generated and processed by a drop detection processor. This process is then repeated with each nozzle of the print head until each has been tested.

Thus, the above described type of drop detection devices may be used to determine whether particular nozzles are ejecting ink drops in response to firing signals. However, such devises do not generally distinguish between an ink drop that is ejected in the correct direction and an ink drop which is ejected in an incorrect direction, as might arise in the event that a nozzle is partly blocked by dried ink, or has been damaged in some way, for example by a print head crash.

As the skilled reader will understand, it is desirable to be able to correctly distinguish between nozzles that eject ink drops in correct and incorrect directions. In the first case, the drops will be correctly placed on the print media, whereas in the second case, the drops will not be correctly positioned on the print media, thus causing a degradation in the quality of the printed output. Such errors in positioning are known as "drop placement errors". Although any directional inaccuracy associated with a nozzle will cause a reduction of image quality, ink jet printers are particularly sensitive to a directional inaccuracy with a direction component perpendicular to the carriage scan direction (indicated by arrow 260 in FIG. 2). This is because a nozzle that suffers from such a defect will print a row of dots which is displaced from its intended location in each swath printed by the print head. This may give rise to repeating "lines" on the media which have not received adequate, or possibly any ink coverage. Alternatively, it may give rise to or a line of dots of one colour incorrectly overlying an area filled by a contrasting colour. Consequently, this type of printing defect is often particularly noticeable to the human eye.

In practice this means that this type of prior art drop detection device may indicate that a given nozzle is functioning correctly, when in fact the nozzle is printing ink drops with noticeable and undesirable drop placement errors, which reduce the quality of an image. Thus, the nozzle will be used in a printing operation, without being subject to a maintenance procedure to correct the error, or alternatively not used.

A known method of determining the directionality and correct functioning of nozzles of an ink jet print head includes implementing print routines where a print head is controlled to print test patterns using known nozzles to print drops in pre-determined positions on a piece of print media. The resulting test pattern is then scanned using a line scanner built into the printer. In this manner, the scanned measurements of actual dot placements may be compared with the intended positions; thus providing information on the correct functioning, including directionality, of each nozzle. However, there are disadvantages associated with such an approach. Firstly, such tests require the use of print media, which represents an additional cost to the user of the printer device. Secondly, the printing and scanning process is comparatively time consuming. Furthermore, it is not generally possible to implement such test procedures in an automatic manner, as and when required, under the control of the printer device; i.e. without the need for operator intervention.

It would therefore be desirable to provide a system and method for correctly determining the usability of nozzles in a print head which overcomes one or more of the disadvantages associated with the prior art methods

SUMMARY OF THE INVENTION

According to the present invention there is provided an ink jet apparatus comprising a nozzle arranged to eject ink droplets and an edge detector arranged to detect droplets having a first range of trajectories and arranged not to detect droplets having a second range of trajectories, the nozzle being arranged to eject one or more first droplets from each of a plurality of positions known relative to the edge detector, the positions being arranged such that the number of first droplets detected by the edge detector varies in dependence upon the magnitude of a component of the ejection direction of the nozzle, the apparatus being arranged to substantially determine a component of the ejection direction of the nozzle in dependence upon the detection by the edge detector.

By arranging a nozzle of an ink jet apparatus to eject a series of ink drops from known positions relative to an edge or drop detector and detecting which of those drops pass through a known range of positions, as defined by the detection zone of the drop detector, it is possible to determine a direction component of the flight path of the drops relative to the nozzle; i.e. a component of the direction of ejection of the drops. Preferably, this is achieved by ejecting a series of drops in substantially the same direction, that are also ejected from substantially equally spaced positions along a line that traverses the edge of the edge detector. In this manner, a proportion only of the drops will be detected, and a component of the ejection direction of the nozzle may be determined from the detected proportion.

Preferably the apparatus is arranged to yield a two different component of the ejection direction of the nozzle in question. In this manner, components of direction of the ejected ink drops may be obtained in two orthogonal axes; for example the media feed axis and the scan axis of the printer. Preferably this is achieved by arranging two drop detectors under the scan axis of the printer, arranged at differing angles to the scan axis. Preferably, the drop detectors are arranged at 90 degrees to each other. As a printhead of the printer, comprising the nozzle in question, traverses the scan axis of the printer, a component of the direction of ejection of the nozzle may be obtained using the detection output of each the two drop detectors.

Preferably, different nozzles of the print head will are arranged to pass over each detector at different times as the print head moves in the direction of the scan axis. This means that with each pass of the printhead over a detector more than one nozzle may be tested. Thus, a large proportion, if not all, of the nozzles in a given printhead may be rapidly tested in a reduced number of passes over the drop detectors.

Preferably, the printer is arranged to pass over both the print medium and at least one of the two drop detectors in each pass along the scan axis while printing. In this manner, it is possible to test the directionality and functioning of selected nozzles of a selected printhead during the printing of an image. This allows the printer to modify the usage of tested nozzles during a print operation in dependence upon the test results for those nozzles. For example if a nozzle is found not to be ejecting ink drops or ejecting ink drops in an incorrect direction, that nozzle could be withdrawn from use for the remainder of the printing operation by allocating its work load to further nozzles. In this manner, output print quality may be increased.

Thus, the method and apparatus of the present invention may be implemented in an automatic manner, requiring no operator input. Furthermore, the directionality of nozzles of a printer may be tested without the need for the requirement for scanning print patterns printed on print media.

The present invention also extends to the corresponding method. Furthermore, the present invention also extends to a computer program arranged to implement the present invention in conjunction with suitable hardware.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example only the best mode contemplated by the inventors for carrying out the invention.

System of the Present Embodiment

Figure 3A:
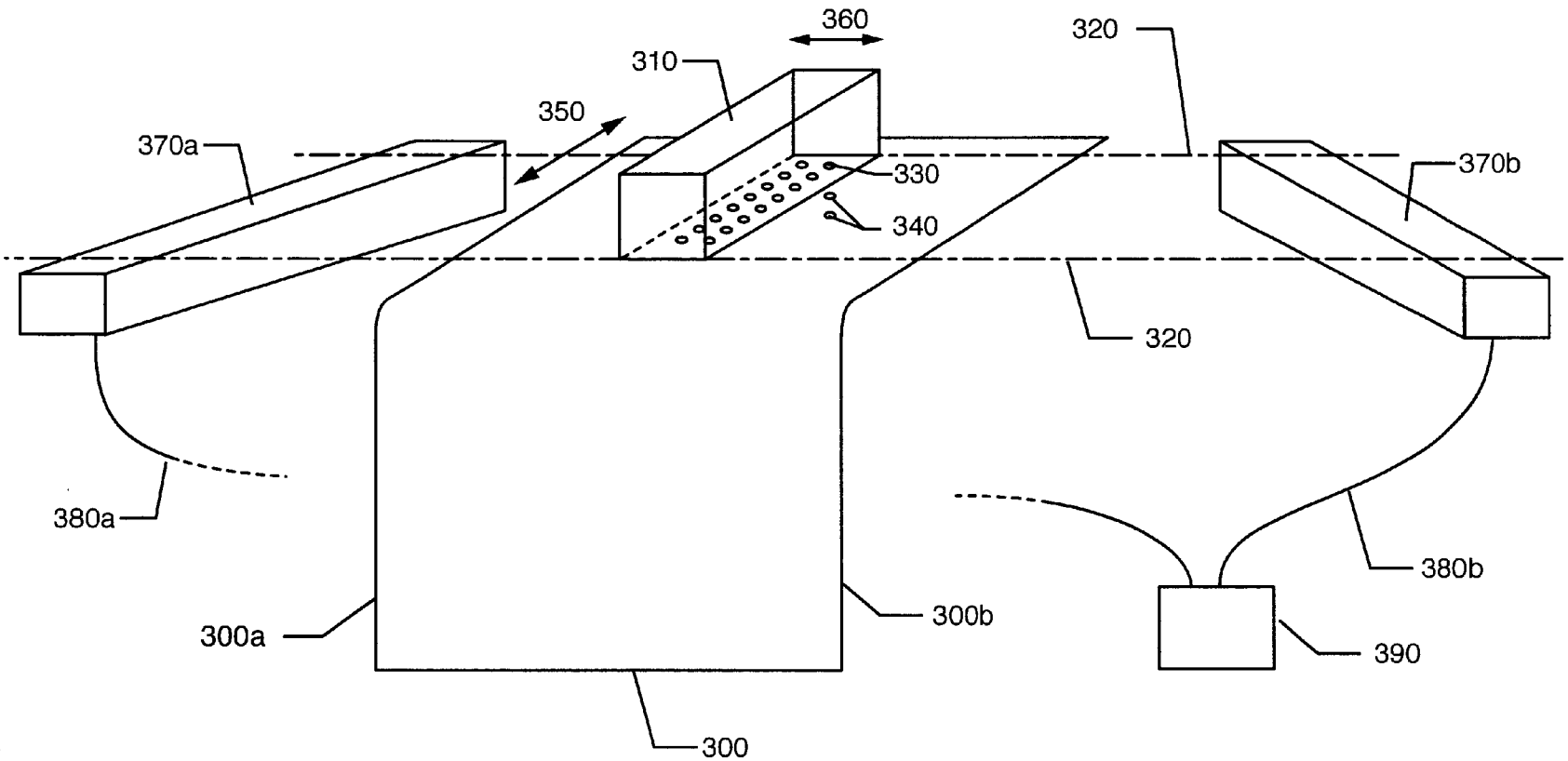
FIG. 3*a* illustrates a partial schematic perspective view of the apparatus of an embodiment of the present invention.
Figure 3B:
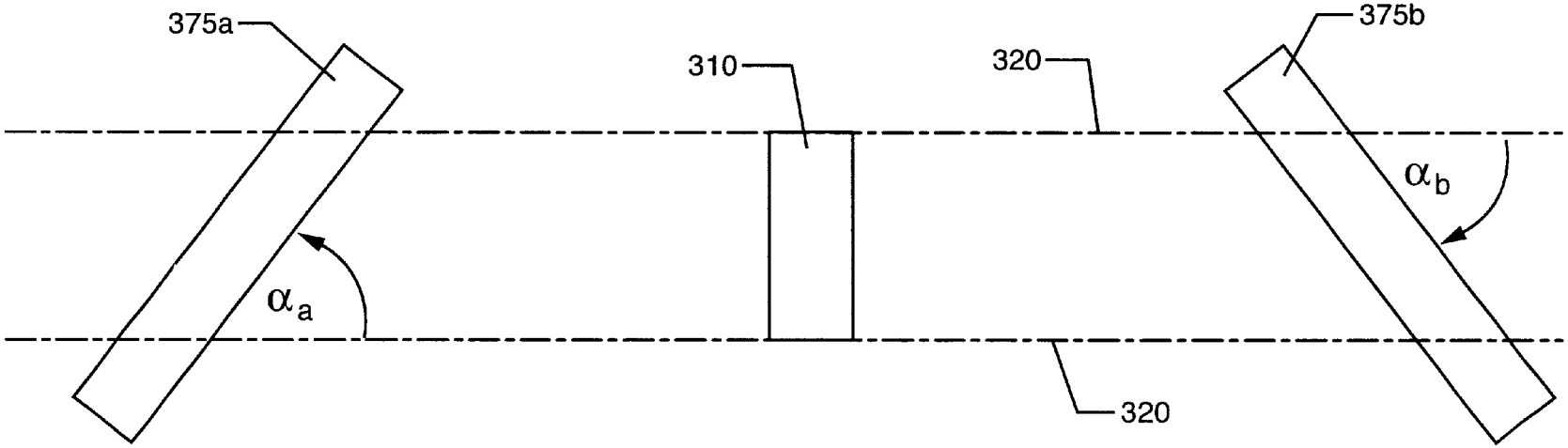
FIG. 3*b* illustrates a partial plan view of the apparatus shown in FIG. 3*a;*

Referring now to FIGS. 3*a* and 3*b*, the system of the present embodiment will now be described. FIG. 3*a* shows a schematic partial perspective diagram of the drop detection system of the present embodiment, and FIG. 3*b* illustrates a partial plan view of the drop detection system of FIG. 3*a*.

Figure 1:
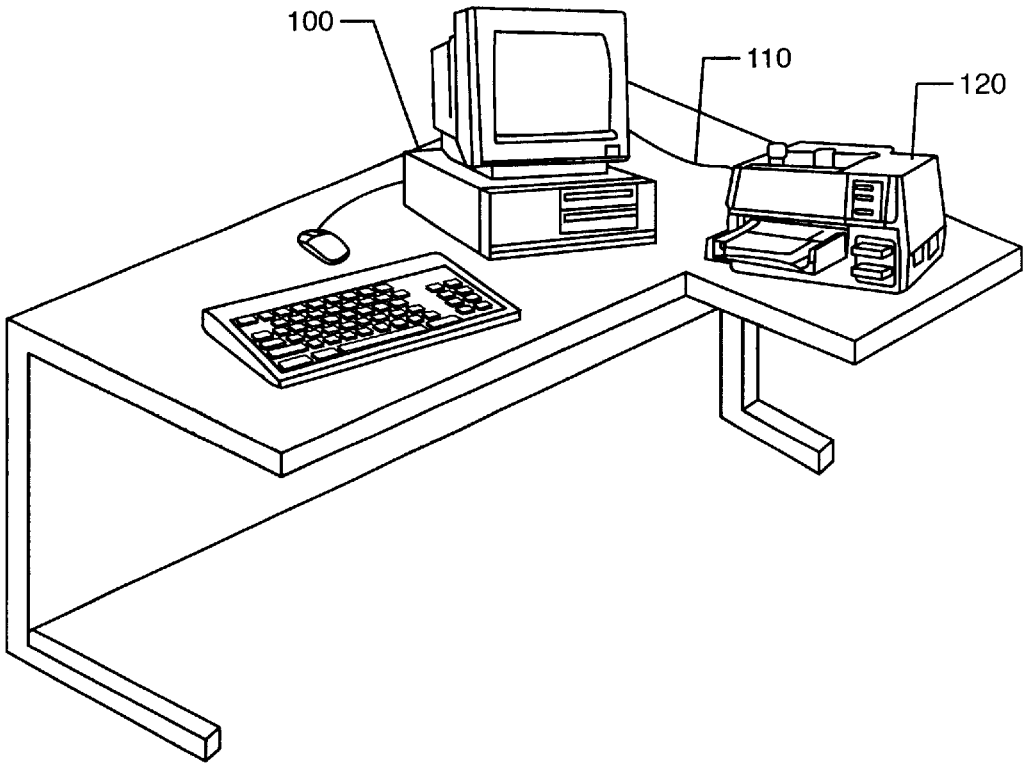
FIG. 1 PRIOR ART
FIG. 1 illustrates a prior art printing system incorporating a personal computer linked to a printer.
Figure 2:
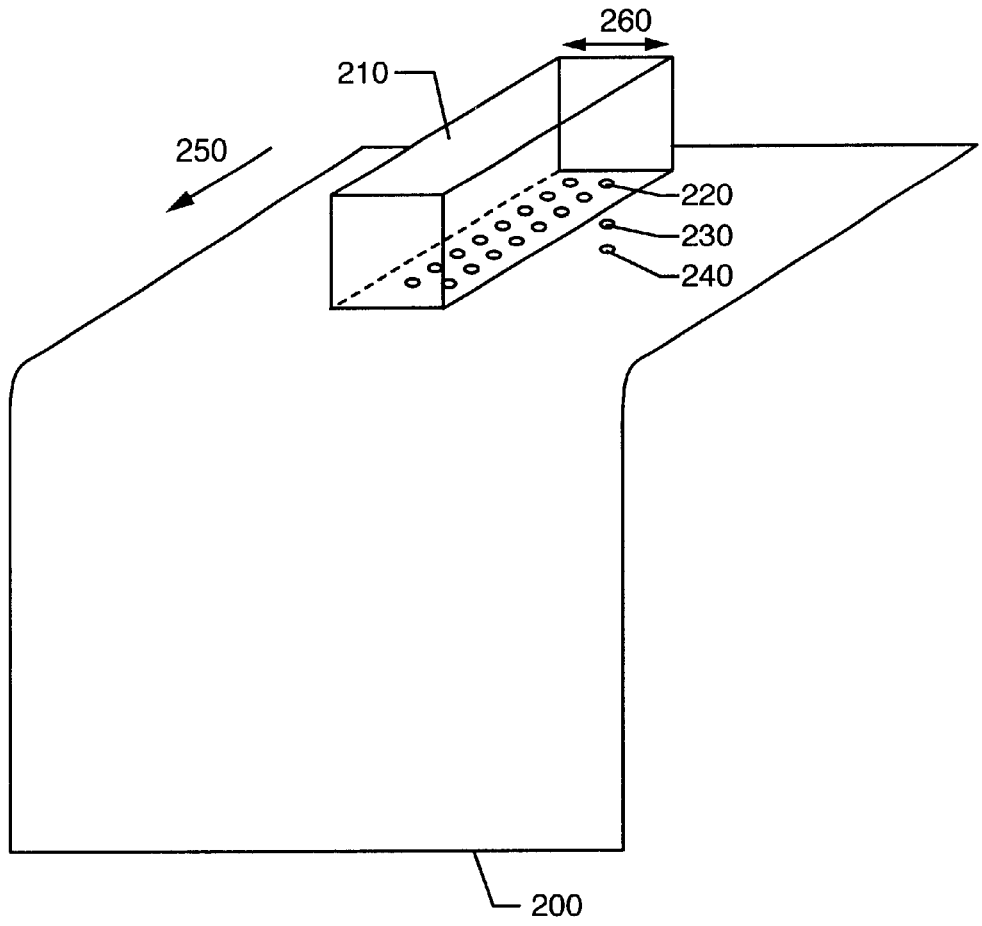
FIG. 2 PRIOR ART
FIG. 2 illustrates schematically part of a prior art print head in relation to the print media on which it prints.

In FIG. 3*a*, a print media 300 is illustrated in position ready for printing. As can be seen from the figure, the print media 300 is free to move forwards and backwards in the media feed direction indicated by the arrows 350. It should, however, be noted that the present invention may be implemented without print media being present. A print head 310 is also shown located above the print media 300 and is free to travel in the directions indicated by the arrows 360 along the scan axis. The scan axis is schematically illustrated by dashed lines 320. As was described above with respect to the prior art printer device of FIG. 2, the print head 310 is arranged to eject ink drops 340 from an array of nozzles 330 on to the print media 300 in order to incrementally build up an image.

At either side of the print media 300 are located drop detector units 370*a*, 370*b*. Each drop detector unit is located under the scan axis 320 of the print head 310, such that the upper surface of each drop detector unit is located at approximately the same level as the print media 300. The print head 310 is free to "over-travel" beyond the lateral edges 300*a*, 300*b* of the widest print media for which the printer is designed to handle and beyond the positions of the each drop detector unit 370*a*, 370*b*. In this way, the print head 310 is free to pass over the drop detector units so that each of the nozzles 330 of the print head 310 may be tested by ejecting ink drops through the ink drop detector units 370*a*, 370*b* as required, as will be explained below. The output of the ink drop detector units 370*a*, 370*b* are connected by connectors 380*a*, 380*b*, respectively, to a printer controller 390 where the outputs are processed.

Each drop detector unit 370*a*, 370*b* has a "working section" within which ink drops may be detected. The locations and orientations of the working sections 375*a* and 375*b* of the detector units 370*a*, 370*b*, respectively, are schematically illustrated in FIG. 3*b*. As can be seen from the figure, the working sections 375*a* and 375*b* are positioned at a known angles, $\alpha_a$ and $\alpha_b$, respectively, to the scan axis 320 of the print head 310. In the preferred embodiment, the angle $\alpha_a$ is +45 degrees and $\alpha_b$ is −45 degrees to the scan axis, as is shown in the figure.

The locations of the drop detector units 370*a*, 370*b* and hence their working sections 375*a* and 375*b*, are accurately known relative to the chassis (not shown) of the printer device, to which they are attached. Thus, the position of the print head 310, together with each of the nozzles 330 in its nozzle array, is known relative to each drop detector unit 370*a*, 370*b* by the printer controller 390, as the print head 310 moves along the scan axis.

Conventionally, the position measurement of the print head 310 is carried out using a position encoding belt, mounted on the printer device, in conjunction with an optical encoder attached to the print head carriage. However, any suitable system may be used for this purpose. Thus, the velocity of the print head 310 is known as it travels across the scan axis 320. Furthermore, the velocity of the ejected ink drops, together with their flight path characteristics, for a given print carriage velocity is also known. Therefore, the nozzles may be controlled to eject drops that accurately pass through predetermined locations of the working sections 375*a* and 375*b* of the drop detector units 370*a*, 370*b*.

Figure 4A:
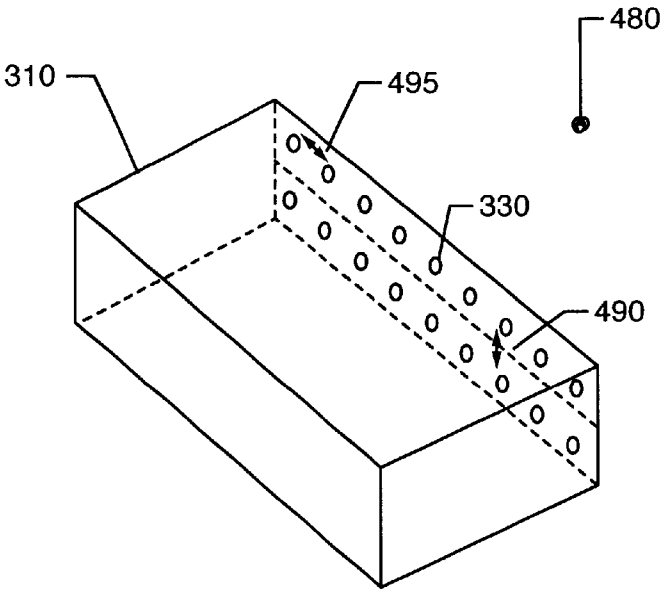
FIG. 4*a* illustrates schematic perspective view of a print head used in an embodiment of the present invention.

Referring to FIG. 4*a*, there is illustrated schematically the print head 310, which is a conventional ink jet print head and is described here briefly for the purposes of completeness. The print head 310 comprises an assembly of printer nozzles 330. Preferably, the print head 310 is comprised of two rows of printer nozzles 330, each row containing 524 printer nozzles. According to the present embodiment, the printer nozzles in one row are designated by odd numbers and the printer nozzles in the second row are designated by even numbers. Preferably, a distance 490 between corresponding nozzles of the first and second rows is of the order 4 millimeters and a distance between adjacent printer nozzles 495 within a same row is 2/600 inches (approximately 0.085 mm). There is an offset of 1/600 inches (approximately 0.042 mm) between immediately adjacent nozzles in the first and second rows of the print head yielding a printed resolution of 600 drops per inch (23.62 drops per mm).

The print head 310 is configured, upon receiving an instruction from the printer, to spray or eject a single drop of ink 480 from a single nozzle 330 of the nozzle array. Thus, each of the nozzles 330 of the print head 310 is configurable to release a timed sequence of ink drops in response to an instruction from the printer device. As is described in more detail below, by spraying a timed sequence of ink drops, it may be determined whether the nozzle in question is functioning correctly using the method of the present embodiment. The operation of spraying a pre-determined sequence of ink drops is also known as "spitting". The frequency at which consecutive drops are ejected is known as the "spitting frequency" or "ejection frequency".

Figure 4B:
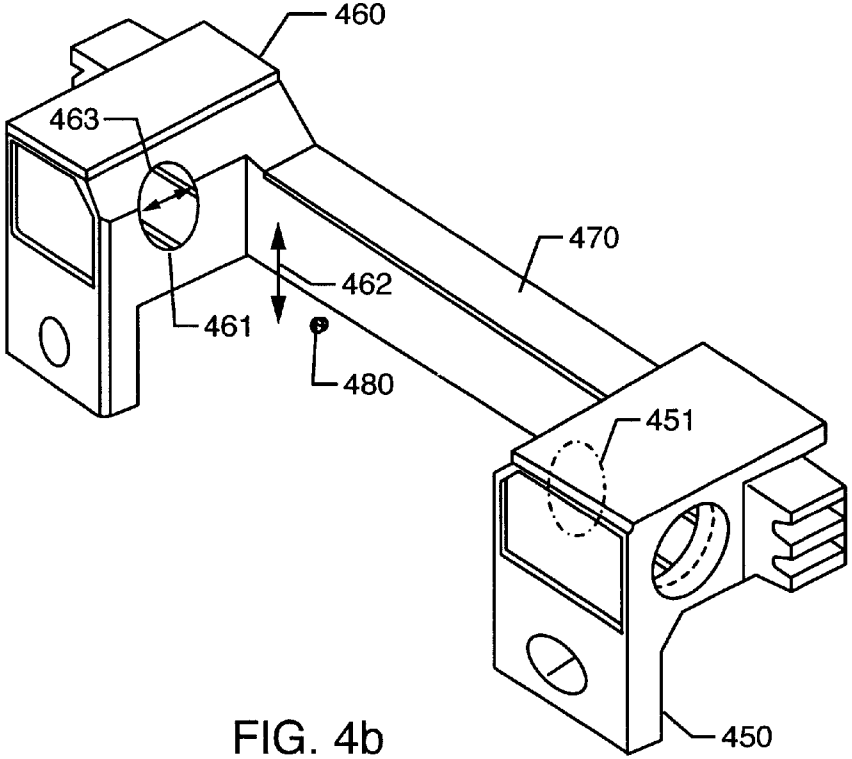
FIG. 4*b* illustrates a perspective view of part of a drop detection unit used in an embodiment of the present invention.

Referring to FIG. 4*b*, the support structure of an ink drop detection unit corresponding to ink drop detection units 370*a*, 370*b* is illustrated schematically. This type of ink drop detection units is known and is described here briefly for the purposes of completeness. However, a more complete description of this unit, which is hereby incorporated by reference, is given in European Patent Application No. 1027987 in the name of Hewlett-Packard Co, which is hereby incorporated by reference.

The ink drop detection unit includes a housing which is made up of three sections; an emitter housing 460, in which a high intensity infra-red light emitting diode is located; a detector housing 450 in which a photo diode detector is located; and, an elongate, rigid portion, or bar 470, which joins the two housing portions in a fixed position, one relative to the other. The emitter housing 460, and the detector housing 450 each include a rigid locating means which ensures that the high intensity infra-red light emitting diode (not shown) and the photo diode detector (not shown) are accurately orientated and positioned with respect to each other so that the light emitted by the light emitting diode is incident on the photo diode detector.

The high intensity infra-red light emitting diode contained within emitter housing 460 is encapsulated within a transparent plastics material casing. The transparent plastics material casing is configured so as to collimate the light emitted by the light emitting diode into a light beam. The collimated light beam emitted by the high intensity infra-red LED contained within emitter housing 460 exits the emitter housing via aperture 461. The collimated light beam from emitter housing 460 is admitted into detector housing 450 by way of aperture 451. The light beam admitted into detector housing 450 illuminates the photo diode detector contained within detector housing 450. An ink drop 480 sprayed from a nozzle 330 entering the collimated light beam extending between apertures 461 and 451 causes a decrease in the amount of light entering aperture 451 and hence incident on the photo diode contained with detector housing 450. Ink drops are only detected if they pass through an effective detection zone, or working section 375 (illustrated in FIG. 3*b*) in the collimated light.

The construction of the drop detection unit as described above has been found to give a sharp transition between detecting a drop which passes through the edge of its working section, and not detecting a drop which passes slightly outside of its working section. This characteristic of this drop detection unit has been found to be desirable in the operation of the present embodiment, as is explained below.

Although in the present embodiment, the sharp "edge" of the detector achieved using optics, the skilled reader will realize that one or more mechanical edges may instead be used to accurately define the regions in the detector in which droplets will be detected.

The ink drop detection units 370*a*, 370*b* are orientated in the present embodiment such when an ink drop 480 is ejected from any given correctly operating nozzle 330 of the print head 310, it will pass through the working section 375 of either of the ink drop detection units 370*a*, 370*b*, provided that the print head 310 is suitably positioned along the scan axis of the printer device when the ink drop is ejected. However, it is preferable that the collimated light beam is substantially perpendicular to the firing direction of the nozzles 330 of the print head 310, whilst being orientated at 45 degrees to the scan axis 320, as shown in FIG. 3*b*.

In order to maximize the probability of being able to simultaneously detect each drop in the sequence of drops that passes through the working section 375 of a drop detection unit 370, it is important that the width of the working section 375 in the direction of travel of the drops is greater than the distance between the first and last drops, as the drops pass through the working section 375. The distance between the first and last drops of the sequence of drops in the working section 375 is determined by parameters including the following: the initial ejection speed of ink drops from a nozzle 330; and, the distance from the nozzle output to the working section 375.

Due to effects of air resistance the initial speed of the ink drops leaving the nozzles is progressively reduced the further each ink drop travels from the print head. A consequence of the progressive slowing, due to air resistance, of a sequence of ink drops fired from a nozzle is that the distance between each drop of the sequence of drops decreases with time.

Thus, for a given initial ejection speed of the drops leaving the print head 310, the closer the print head is to the working section 375, the wider the working section 375 must be. However, increasing the width of the working section 375 necessitates a proportional increase in the time between firing ink drops from consecutively tested nozzles, thereby increasing the total time required to perform drop detection of a given number of nozzles. This is the case in order to avoid concurrently detecting ink drop sequences ejected by different nozzles. Conversely, if the distance between the print head and the working section 375 is large, then for a given width of the working section 375 the distance between the first and last ink drops of the sequence of ink drops may be significantly smaller than this given width. Consequently, there is a possibility that a drop fired from a further nozzle being tested previously or subsequently might mistakenly be detected concurrently with the sequence of ink drops ejected from the nozzle currently being tested. Additionally, increasing the distance between the print head 310 and the working section 375 again increases of time duration required between sequences of ink drops from adjacent nozzles of the print head 310 thereby increasing the total time required before drop detection. Hence it is necessary to optimize the various parameters, for example, the width of the working section 375 and distance from the print head 310 to the working section 375, in order to minimize the probability of simultaneously detecting drops ejected from nozzles that are consecutively tested, whilst also minimizing the total time required to perform drop detection. The optimization may be performed experimentally.

Figure 5:
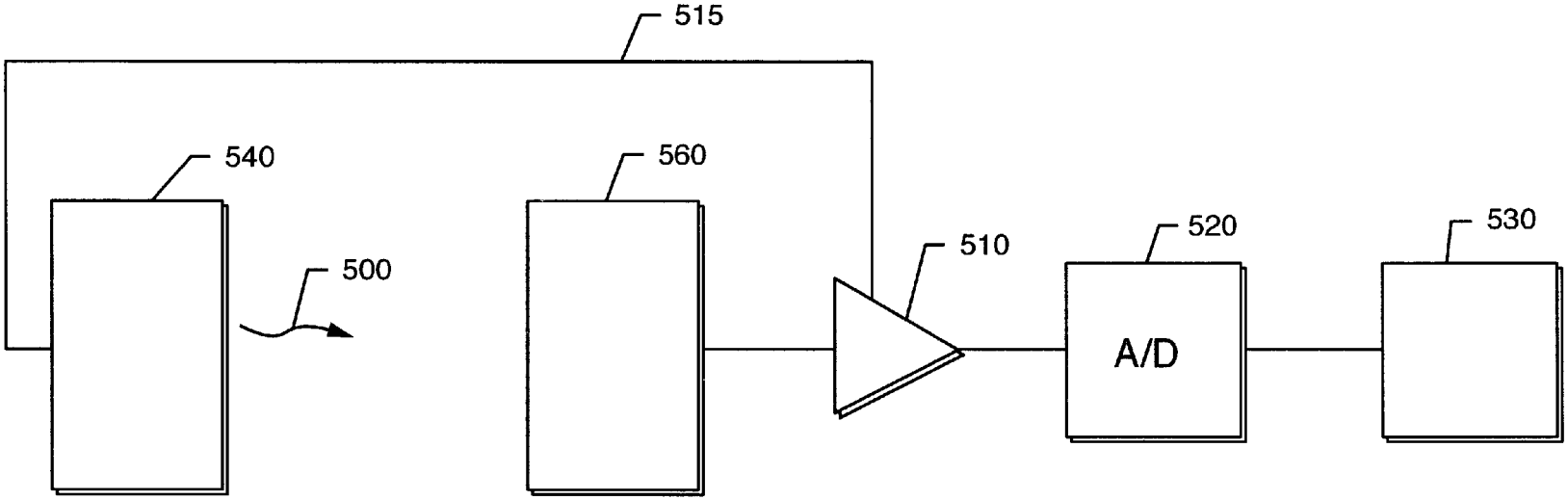
FIG. 5 illustrates a generalised block diagram of the functional blocks of the drop detection system of FIG. 4*b;*

Referring to FIG. 5, there is illustrated a generalised block diagram of the functional components of a drop detection unit as illustrated in FIG. 4*b*.

The high intensity infra-red LED 540 emits light 500 which is absorbed by the photo diode detector 560. The photo diode detector 560 generates a current in response to the incident light. This current is output to, and amplified by an amplifier 510.

The amplifier 510 is configured to increase the driver current to the high intensity infra-red LED 540, via signal path 515, in response to a decrease in the output current of the photo diode detector 560. The amplifier 510 is further configured to decrease the input current into the high intensity infra-red LED 540 in response to an increase in the output current of the photo diode detector 560, again via signal path 515. This arrangement has the effect of causing a characteristic sine shaped pulse output to be generated by the photo diode detector 560 in response to the LED 540 being temporarily occluded by one or more ink drops. This is because when the light of the LED 540 is occluded, the consequent decrease in output current of the photo diode detector 560 is detected. As a result the input current to the LED 540 is increased. However, due to the comparatively slow response time of the input current increase for the LED 540, combined with the fact that the ink drops subsequently cease to occlude the LED 540 from the photo diode detector 560, an overshoot in the photo diode detector 560 output current results. In the absence of the occluding ink drops, the output of the photo diode detector 560 subsequently returns to its normal output level.

The amplified, output current of amplifier 510 is then input into an analogue to digital (A/D) converter 520. The A/D converter 520 repeatedly samples the amplified output of the photo diode to generate a sequence of digital sample signals, each quantized to represent an amplitude of a portion of the output signal pulse of the ink drop detection units 370 during a testing operation.

The skilled reader will appreciate that the sampling rate will determine the accuracy with which the output of the photo diode detector 560 may be determined at any given time. The accuracy with which the output of the photo diode detector 560 needs to be determined depends upon various factors. These include, the initial ejection speed of ink drops from a nozzle 330; the distance from a nozzle output to the working section 375; and, the desired sensitivity of the drop detection system to drop placement errors. Thus, the sampling rate may be determined experimentally. However, in the present embodiment, it is preferable that the A/D converter 520 samples the amplified output current with a sampling frequency of 40 kilohertz, and more preferably 80 kilohertz.

The samples of the output of the photo diode 560 are stored within a memory device 530 associated with the drop detection units 370. The drop detection unit 530 then processes the sampled output of the photo diode detector 560 to determine whether or not one or more ink drops have passed through the working section 375 of the drop detection unit 370. This information is then output to the printer controller 390 shown in FIG. 3*a* in order that operating characteristics of the printer nozzles may be determined, as is described below. However, The skilled reader will appreciate that the function of each of the amplifier 510, the A/D 520 and the memory device 530 for each drop detection unit 370*a*, 370*b* may in practice be incorporated into the printer controller 390.

Mode of Operation

In the preferred embodiment of the present invention, the functioning of the nozzles of a given print head of the printer device are checked periodically during the printing of an image in order to establish whether or not they are functioning correctly, or at least to within preset tolerance limits. Thus, the drop detection process of the present embodiment is carried out for a proportion of the nozzles in between printing consecutive print passes of an image, or, "on the fly". With successive passes, different nozzles may be tested, until such time that all of the nozzles have been tested and the testing cycle may recommence.

In this manner, the print mode which is being used to print an image may be changed, during the process of printing an image, in order to avoid printing with any nozzles which are discovered to be defective. This may be achieved by assigning the workload that would normally be undertaken by the defective nozzles to correctly functioning nozzles as is described below.

Referring again to FIGS. 3*a* and 3*b* the mode of operation of the present embodiment of the invention will now be described. Prior to printing an image, the printer carriage (not shown) is located under the control of the printer controller 390 in a conventional manner at one end of the scan axis 320. In this example, the printer carriage is located at the extreme left-hand side of the scan axis, as viewed in FIGS. 3*a* and 3*b*. The printer carriage is then accelerated to its normal scan velocity, which in this embodiment is 20 inches per second (508 mm per second), towards the right hand end of the scan axis 320, as viewed in FIGS. 3*a* and 3*b*. The acceleration phase of the print head is completed significantly prior to the point at which the print head 310 reaches the drop detector unit 370*a*.

As the print head 310 reaches the drop detector unit 370*a*, a drop detection routine is implemented for selected nozzles 330 of the print head 310, as is explained more fully below. The print head 310 then continues to travel at a constant velocity along the scan axis 320. As the print head 310 passes over the print medium 300, ink drops are ejected from the nozzles 330 of the print head 310 in a normal manner in order to incrementally print the required image, as has been described above with respect to FIG. 2. When the print head 310 subsequently passes the drop detector unit 370*b*, a further drop detection routine is implemented for the same selected nozzles 330 of the print head 310, as is again explained more fully below. Only when the print head has passed the drop detector unit 370*b* does it start decelerating, in readiness to return along the scan axis 320 in order to print more of the image.

Figure 3C:
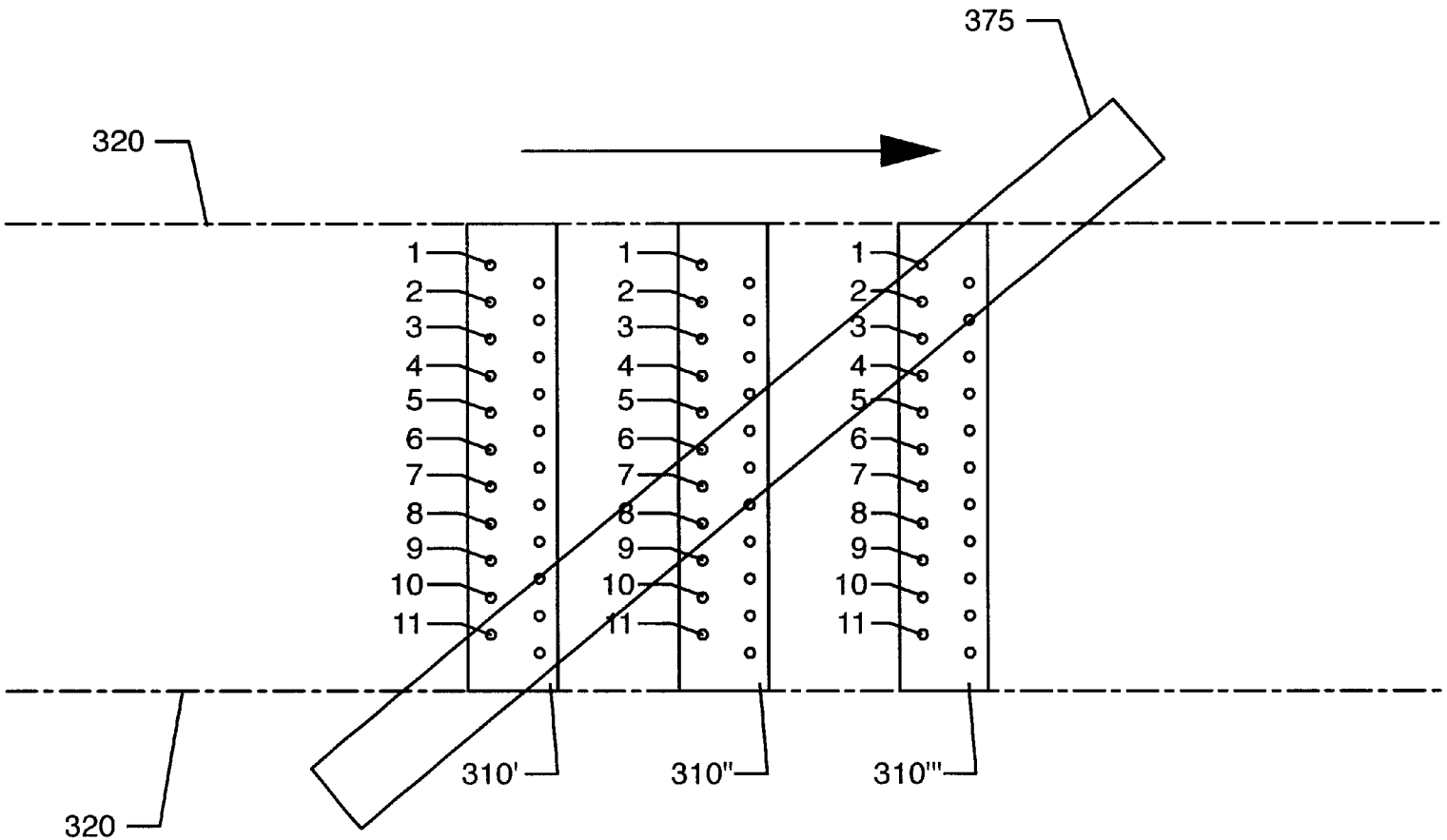
FIG. 3*c* illustrates the manner in which a print head of a printer device passes over a drop detection unit according to an embodiment of the present invention.

As has been stated above, in order that a given signal output by the photo diode detector 560 can be attributed to a particular nozzle, it is important that ink drops from only one nozzle is detected by the drop detector unit 370*a* at any given moment. However, as the working section 375 of the drop detector unit 370*a* lies at an angle to the scan axis and print head 310, different nozzles 300 on the print head 310 will pass over the working section 375*a* of the drop detector unit 370*a* at different moments in time. Thus, a "family" or "group" of nozzles 300 from the nozzle array of a print head 310 may be tested in a single "pass" over the working section 375. That is to say that each member of a given family of nozzles may be tested sequentially, whilst preserving adequate temporal separation between each nozzle 300 in the family to ensure that the ink drops detected by the drop detector unit 370 may be uniquely identified with a given nozzle 300 of that family. Of course, this may still be achieved without requiring the print head to stop or change its speed. This concept is illustrated in FIG. 3*c*, where a print head 310 is schematically illustrated progressively moving in the direction of the scan axis 320, as represented by the arrow, over the working section 375 of a drop detector unit 370. At different times $t_1$, $t_2$ and $t_3$, the print head position is labeled 310', 310" and 310''', respectively. Referring now to the nozzles numbered 1–11 in the left hand column of nozzles, it can be seen that at time $t_1$, nozzle 11 overlies the working section 375 of the drop detector unit 370. However, at time $t_2$, nozzles 6–8 overlie the working section 375 and at time $t_3$, nozzles 2 and 3 overlie the working section 375.

The drop detection routine according to the present embodiment will now be described. When a selected nozzle 330 of the print head 310 reaches the correct location along the scan axis 320 relative to the drop detector unit 370*a* a drop detection routine is implemented. A series of ink drops of a substantially uniform volume, are ejected at a constant frequency from the nozzle 330. In the preferred embodiment, the series of ink drops consists of six separate drops of ink, which are ejected at a frequency of 12 kilohertz. The skilled reader will appreciate that by increasing the frequency of ejection, the resolution with which the ejection direction of nozzles may be determined may be increased. Similarly, the number of ink drops in the series may be varied in order to match working requirements.

Due to the fact that the printer carriage is moving at a constant velocity throughout the drop test procedure, the locations along the scan axis 320 at which each of the ink drops are ejected are equally spaced. Consequently, each of the ink drops in the sequence follows a similar flight path, or trajectory, differing only in that each flight path is separated from the flight path or paths of immediate neighbours by a fixed known distance along the scan axis 320. The exact instant at which the series of drops starts to be ejected is determined such that if the nozzle under test is operating correctly, the first three drops in the sequence will be ejected too early to pass through the working section 375*a* of the drop detector unit 370*a*. Consequently, the first three drops will not be detected by the drop detector unit 370*a*. However, each of the last three drops only of the sequence will pass through the working section 375*a* of the drop detector unit 370*a* and will therefore be detected.

Figure 6A:
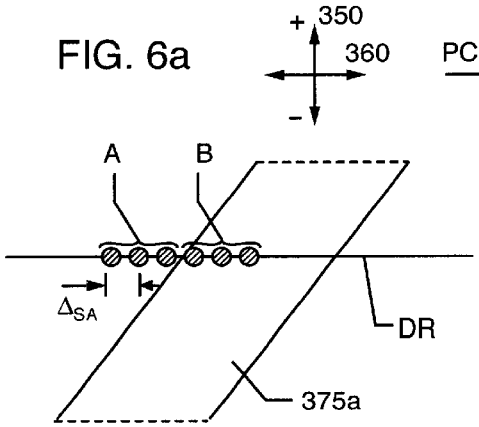
FIGS. 6*a*–15*a* schematically illustrate the detection of various series of ink drops by a drop detection unit in an embodiment of the present invention and FIGS. 6*b*–15*b* schematically illustrate the corresponding detection signals generated by the drop detection unit.

The detection of a series of drops, ejected from a correctly operating nozzle which imparts no drop placement error to the drops which it ejects is shown in FIG. 6*a*. This figure shows an enlarged, partial, schematic, plan view of the working section 375*a* of drop detector unit 370*a* as shown in FIG. 3*b*. Also indicated on the figure are: the printer carriage direction, indicated by the arrow labeled "PCD", at the time the sequence of drops was ejected; the correct "dot row" for the nozzle under test, which is referenced by dotted line labeled "DR" and indicates the correct placement for ink drops ejected by the nozzle under test in the media feed direction 350; and, the orientation of the scan axis and the media feed direction, which are indicated by the arrows referenced 360 and 350, respectively, which correspond to the equivalent numerals shown in FIG. 3*b*.

In the figure, the position along the scan axis 320 of each of the drops in the sequence is shown, at the point in time that the drop sequence is detected by the drop detector unit 370*a*.

The drop separation $\Delta_{sa}$ between adjacent ink drops in the direction of the scan axis is a function of the print carriage velocity and the ejection frequency of the nozzle 330 under test. In this example, the carriage velocity is 20 inches per second, or 508 mm per second. The spitting frequency is 12 kilohertz. Therefore, the distance $\Delta_{sa}$ between adjacent ink drops in the direction of the scan axis is (508/12000) mm, or 0.0423 mm.

As can be seen from the figure, each of the drops is correctly centered along the desired dot row "DR". Thus, the nozzle 330 under test is ejecting ink drops with no directional errors in the media feed direction 350.

It can also be seen from the figure that the position of the first three ink drops of the sequence to be ejected, referenced "A" in the figure, lie before, and so outside of the working section 375 of the drop detector unit 370*a*. Thus, these drops remain undetected by the drop detector unit 370*a*. However, the remaining three drops, referenced "B" in the figure, each pass through the working section 375 of the drop detector unit 370*a* and so are detected by the drop detector unit 370*a*.

As has been explained above, the signal which is output by the photo diode detector 560 is dependent upon the amount of light emitted by the LED 540, which is incident upon it. In the present embodiment the volume of each ink drop in a given sequence is substantially the same, as are the volumes of ink drops ejected by different nozzles under test. Therefore, the amplitude of the signal output by photo diode detector 560 is dependent upon the number of drops which simultaneously occlude LED 540 from the photo diode detector 560; i.e. the number of drops which simultaneously pass through the working section 375 of the drop detector unit 370*a*.

Figure 6B:
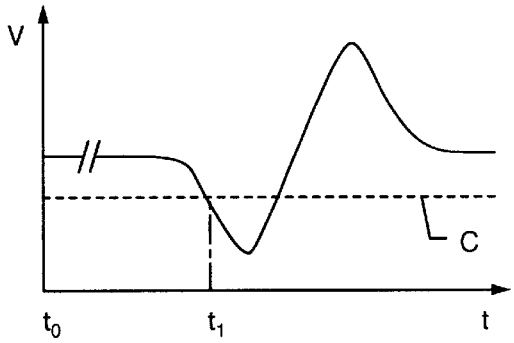

The characteristic pulse shaped signal output by the photo diode detector 560 of the drop detector unit 370*a* corresponding to the detection situation shown in FIG. 6*a* is shown in FIG. 6*b*. FIG. 6*b* shows how the voltage output of the photo diode detector 560 varies with time. On the figure two timing points $t_0$ and $t_1$ are shown. The time at which the nozzle under test commenced ejecting the sequence of drops is indicated by to and the point in time at which the output of the photo diode detector 560 falls below a preset threshold is indicated by $t_1$. In this case, the threshold is represented by the dotted line "C" in the figure.

The skilled reader will appreciate that if the nozzle under test is blocked, then no ink drops will be ejected. Consequently, no characteristic pulse shaped signal equivalent to that shown in FIG. 6*b* will be generated; i.e. the output of the output of the photo diode detector 560 will remain substantially constant. In such situations, the printer controller may designate the nozzle 330 under test as defective. The printer controller may then implement maintenance routines to correct the operation of the nozzle as described more fully below. Alternatively, or in the event that the maintenance routines are found to have failed to correct the operation of the nozzle after further testing, the printer controller may implement measures to avoid using that nozzle during subsequent printing operations as described more fully below.

Referring to FIGS. 7 to 10, the detection of further series of drops is illustrated. In these figures, the changes in the signals output by the photo diode detector 560, caused by different types of drop placement errors in the nozzles under test, will be described. Each of FIGS. 7*a*, 8*a*, 9*a*, and 10*a* shows a similar view of the working section 375*a* the drop detector unit 370 to that shown in FIG. 6*a*. The correct "dot row" for the nozzle under test is also shown in each of these figures, as it is shown in and described with reference to FIG. 6*a*. In each of these figures, the printer carriage direction PCD at the time the sequence of drops was ejected and the media feed direction 350 and scan axis 360 are as shown in FIG. 6*a*. Each of FIGS. 7*b*, 8*b*, 9*b*, and 10*b* shows the corresponding detection signal in each case, in the same manner as was illustrated in FIG. 6*b*.

Figure 7A:
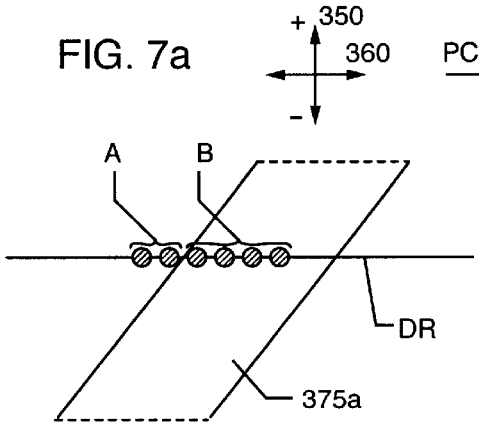

FIG. 7*a*, shows the detection of a series of drops which are directed too far along the scan axis 360, in the direction of travel PCD of the print head carriage; resulting in a drop placement error for each drop ejected. Thus, the first drop of the sequence follows a flight path which takes it closer to the drop detection unit 370*a* than would be the case for an equivalent drop ejected from a nozzle that is functioning correctly, as shown in FIG. 6*a*. Each of the remaining drops in the same sequence follow flight paths with the same shift in direction, as has been described with reference to the first. Thus, as is shown in FIG. 7*a*, only the first two ink drops in the sequence, referenced "A" in the figure, fall short of the working section 375*a* of the drop detector unit 370*a*, with the remaining four drops of the sequence, referenced "B", all passing through the working section 375*a*. This is in contrast to the three drops which passed through the working section 375*a* in the case shown in FIG. 6*a*, where the drops were correctly directed. Thus, the trajectory of a droplet depends upon both the position of the nozzle relative to the drop detector unit 370*a* when the droplet is ejected and the ejection direction of the nozzle.

However, as can be seen from the figure, each of the drops is correctly centered along the desired dot row "DR". Thus, the nozzle 330 under test is ejecting ink drops with no directional errors in the media feed direction 350.

Figure 7B:
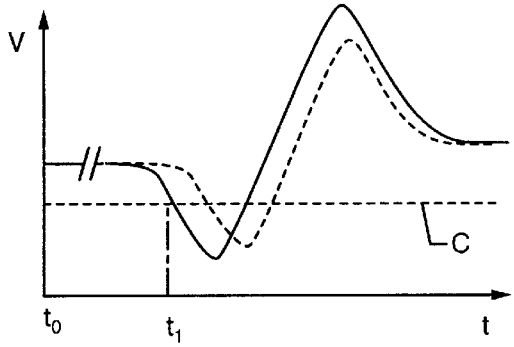

Referring to FIG. 7*b*, the signal output by the photo diode detector 560 for the situation shown in FIG. 7*a* is shown. As can be seen from the figure, the amplitude of the signal output for this case is greater than that corresponding to the correctly directed drops shown in FIG. 6*b*. For, clarity purposes, the output shown in FIG. 6*b* is shown in dotted line in FIG. 7*b*. The reason for the increase in amplitude is that four drops were detected in the case where the drops were misdirected in the scan axis advance sense, as opposed to only three in the case where the drops were correctly directed. Since the amplitude of the signal output by the photo diode detector 560 is dependent upon the number of simultaneously detected drops, an output signal of greater amplitude is generated.

Additionally, because of the third drop in the sequence shown in FIG. 7*a* is detected, whereas it would not be if it were correctly directed as shown in FIG. 6*a*, the signal output in this case is advanced in a temporal sense in relation to the that corresponding to correctly directed drops shown in FIG. 6. Thus, the output of the photo diode detector 560 falls below the preset threshold (represented by the dotted line "C" in the figure) earlier in this case than would be the case if the drops were correctly directed. Thus, the period $(t_1-t_0)$ in the case shown in FIG. 7*b* is less than the corresponding period shown in FIG. 6*b*.

Figure 8A:
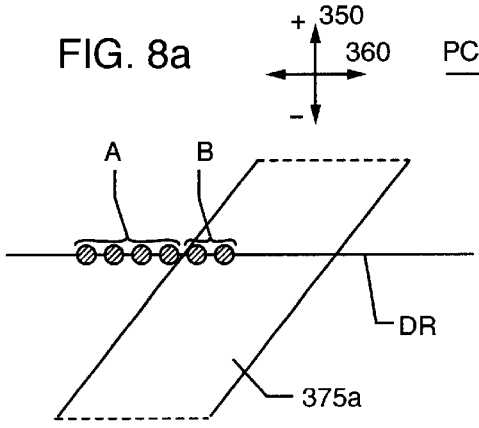

FIG. 8*a*, shows the detection of a series of drops which are directed too far along the scan axis 360, in the direction opposite to the direction of travel PCD of the print head carriage; again resulting in a drop placement error for each drop ejected. In this case, the first four ink drops, referenced "A" in the figure, fall short of the working section 375*a* of the drop detector unit 370*a*. Thus, only the last two ink drops in the sequence, referenced "B" in the figure, pass through the working section 375*a* to be detected. This is as opposed to the three drops which passed through the working section of the drop detector unit 370*a* in the case shown in FIG. 6*a*, where the drops were correctly directed.

Again, as can be seen from the figure, each of the drops is correctly centered along the desired dot row "DR". Thus, the nozzle 330 under test is ejecting ink drops with no directional errors in the media feed direction 350.

Figure 8B:
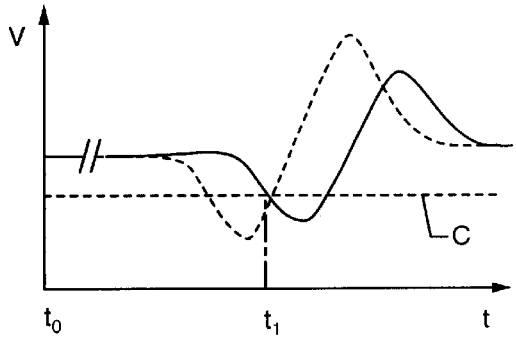

Referring to FIG. 8*b*, the signal output by the photo diode detector 560 of the drop detector unit 370*a* corresponding to the situation of FIG. 8*a* is shown. As can be seen from the figure, the amplitude of the output signal for this case is less than signal output for the detection of the series of drops shown in FIG. 6*a* where the ink drops were correctly directed. This is due to the reduced number of ink drops passing through the working section 375*a* of the drop detector unit 370*a*. Again, for clarity purposes, the output signal shown in FIG. 6*b*, corresponding to a correctly directed sequence of drops, is shown in dotted line in FIG. 8*b*.

Additionally, because in this case the fourth drop in the sequence is not detected, whereas it would be if the sequence were correctly directed, the signal output in this case is delayed in a temporal sense in relation to the that corresponding to correctly directed drops shown in FIG. 6. Thus, the output of the photo diode detector 560 falls below the preset threshold "C" later in this case than would be the case if the drops were correctly directed. Thus, the period $(t_1-t_0)$ in the case shown in FIG. 8*b* is greater than the corresponding period shown in FIG. 6*b*.

Figure 9A:
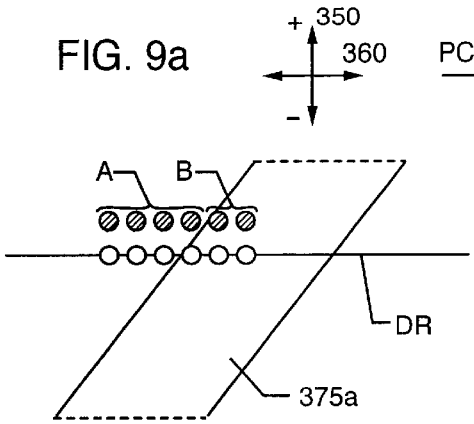
Figure 9B:
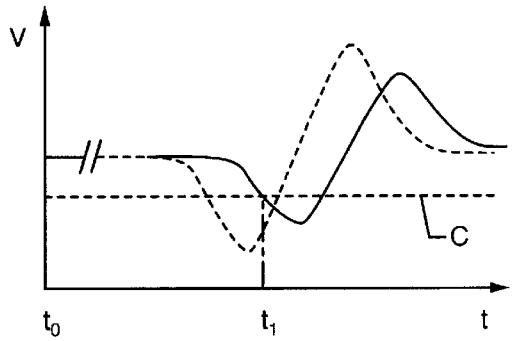
Figure 10A:
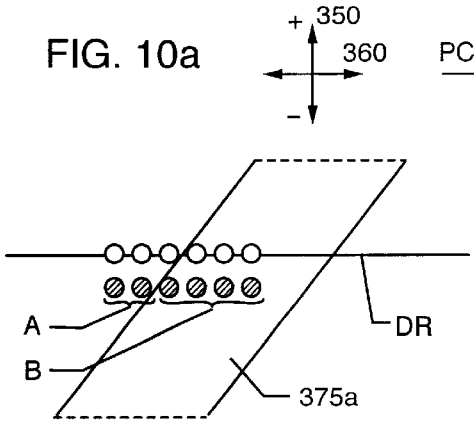

Each of FIGS. 9*a* and 10*a*, show the detection of a series of drops (shown in solid) that are ejected with a drop placement error in the media feed direction 350 (i.e. perpendicular to the scan axis direction 360), whilst having no drop placement error in the scan axis direction 360. Thus, the drops illustrated in FIGS. 9 and 10 form an incorrectly positioned dot row. For the purposes of clarity, the positions of a series of drops that are correctly directed and positioned on the correct dot row DR are shown in outline in the same figures. As can be seen from the figures, in FIG. 9*a*, the drop placement error is in the positive media feed direction and in FIG. 10*a*, the drop placement error is in the negative media feed direction.

As can be seen in the case of FIG. 9*a*, due to the angle $\alpha_a$ of the working section 375*a* of the drop detector unit 370*a* relative to the scan axis 320 (shown in FIG. 3*b*), a drop placement error in the positive media feed direction causes the number of ink drops which pass through the working section 375*a* of the drop detector unit 370*a* to decrease. In this example, the first four drops, referenced "A", fall short of the working section 375*a* of the drop detector unit 370*a* and so are not detected. Thus, only 2 ink drops, referenced "B", pass through the working section 375*a* of the drop detector unit 370*a* to be detected. This is in contrast to three ink drops which would normally pass through the working section 370*a* in the event that the series of drops were correctly directed.

Referring to FIG., 9*b*, the signal output by the photo diode detector 560 corresponding to the situation shown in FIG. 9*a* is shown. As can be seen from the figure, the signal output by the drop detection unit 370*a* has a decreased amplitude relative to that which would result (shown in doffed line in the same figure) if the ink drops were correctly directed. Again, this is because the amplitude of the output signal is dependant upon the number of ink drops that pass simultaneously through the working section 375*a* of the drop detector unit 370*a*.

Furthermore, as can be seen from the figure, and for the same reason as was explained above with regard to FIG. 8*b*, the detection signal corresponding to a sequence of the ink drops misdirected in the positive media feed direction is delayed in time relative to the signal for the correctly directed ink drop sequence; i.e. the period $(t_1-t_0)$ in this case is greater than the corresponding period shown in FIG. 6*b*.

Referring now to FIG. 10*a*, due to the angle $\alpha_b$ of the working section 375*a* of the drop detector unit 370*a* relative to the scan axis 320 (as shown in FIG. 3*b*), a drop placement error in the negative media feed direction causes the number of ink drops which pass through the working section 375*a* of the drop detector unit 370*a* to increase. In this example, only the first two drops, referenced "A", to be ejected fall short of the working section 375*a* of the drop detector unit 370*a* and so are not detected. Thus, four ink drops, referenced "B", pass through the working section 375*a* of the drop detector unit 370*a*. This is in contrast to three ink drops which would normally pass through the working section 370*a* in the event that the series of drops were correctly directed.

Figure 10B:
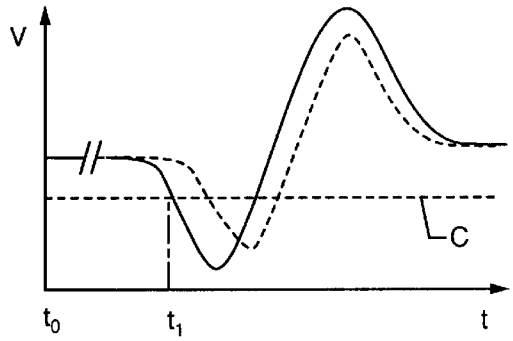

Referring to FIG. 10*b*, the signal output by the photo diode detector 560 corresponding to the situation shown in FIG. 10*a* is shown. As can be seen from the figure, the signal output by the drop detection unit 370*a* has an increased amplitude relative to that which would result (shown in dotted line in the same figure) if the ink drops were correctly directed. Again, this is because the amplitude of the output signal is dependent upon the number of ink drops that pass through the working section 375*a* of the drop detector unit 370*a*.

Furthermore, as can be seen from the figure, and for the same reason as was explained above with regard to FIG. 7*b*, the detection signal corresponding to a sequence of the ink drops misdirected in the negative media feed direction is advanced in time relative to the signal for the correctly directed ink drop sequence; i.e. the period $(t_1-t_0)$ in this case is less than the corresponding period shown in FIG. 6*b*.

As the skilled reader will appreciate, the greater the degree of misdirection of the ink drops in each of the above examples, the greater will be the difference between the number of drops that should pass through the working section 370*a* and the number that actually do so. This in turn will give rise to a greater disparity between the measured amplitude of signal output by the photo diode detector 560 and that measured for a correctly directed series of ink drops. Similarly, any delay or advance in the signal output by the photo diode detector 560 relative to that output for a correctly directed series of ink drops will also increase proportionally. Thus, the skilled reader will appreciate that in each of the above cases, any difference between the measured amplitude of an output signal and the normal amplitude of an output signal will be proportional to the degree of drop placement error for the nozzle under test. Similarly, any difference in the time period between the moment that a sequence of drops is ejected and the moment that a predetermined part of the output signal is detected, between a given drop sequence and a normally directed drop sequence will also be proportional to the degree of drop placement error for the nozzle under test.

Once the print head 310 has progressed past the drop detection unit 370*a*, it proceeds at constant velocity across the print zone of the printer device printing a swath of the image. When the print head 310 has passed over the width of the print media, it continues in the direction of the drop detection unit 370*b*. Upon reaching the drop detection unit

370*b*, a further drop detection routine is carried out as has been described above with regard to the drop detection unit 370*a*. This process is repeated with the same nozzles that were tested in passing the drop detection unit 370*a*. However, since the method of testing the nozzles with drop detection unit 370*b* is substantially the same as has been described with regard to the drop detection unit 370*a*, the process will not be described further in detail.

As the skilled reader will appreciate, the ejection characteristics of a given nozzle will generally be constant in a given pass of the print head 310. Thus, the nozzles tested by the drop detector unit 370*a* at the beginning of the pass will generally exhibit the same ejection characteristics when tested by drop detector unit 370*b*. Therefore, for the purposes of explaining the mode of operation of the present embodiment, the detection by the drop detector unit 370*b* of drops ejected with the same characteristics as illustrated in FIGS. 6 to 10 will now be described with reference to FIGS. 11 to 15, respectively.

Each of FIGS. 11*a*, 12*a*, 13*a*, 14*a* and 15*a* shows a view of the working section 375*b* of the drop detector unit 370*b*, similar to the view of the working section 375*a* of the drop detector unit 370*a* as shown in FIG. 6*a*. As can be seen from FIG. 3*b*, the working section 375*b* of the drop detector unit 370*b* is orientated at $\alpha_b$ to the scan axis 320; i.e. at 90 degrees to the angle of orientation $\alpha_a$ of working section 375*a*. Again, in each of these figures, the printer carriage direction PCD at the time the sequence of drops was ejected, the correct "dot row" for the nozzle under test, together with the media feed direction 350 and the scan axis 360 are referenced in the same manner as in FIG. 6*a*. Each of FIGS. 11*b*, 12*b*, 13*b*, 14*b* and 15*b* shows the detection signal in each case, in the same manner as was illustrated in FIG. 6*b*.

Figure 11A:
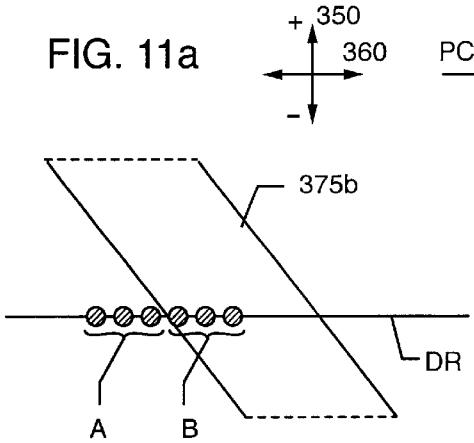

Referring now to FIGS. 11*a* and *b*, 12*a* and *b*, and 13*a* and *b*, the detection and corresponding output signal for three sequences of drops are shown. The drops in FIGS. 11, 12 and 13 have the same ejection characteristics as those shown in FIGS. 6, 7, and 8, respectively, as indeed would be the case if they were ejected by the same nozzles. Thus, the sequence of drops shown in FIG. 11 is correctly directed. The sequence of drops shown in FIG. 12 is directed too far along the scan axis 360, in the direction of travel of the print head carriage PCD. The sequence of drops shown in FIG. 13 is directed too far along the scan axis 360, in the direction opposite to the direction of travel of the print head carriage PCD. However, as can be seen from each of FIGS. 11*a*, 12*a* and 13*a*, each of the sequences of drops are correctly centered along the desired dot row "DR". Thus, in each case, the nozzle 330 under test is ejecting ink drops with no directional errors in the media feed direction 350.

As can be seen from each of FIGS. 11*a*, 12*a* and 13*a*, the same number of drops pass through the working section 375*b* of the drop detector unit 370*b* as passed through the working section 375*a* of the drop detector unit 370*a* in each corresponding case; as shown in FIGS. 6*a*, 7*a* and 8*a*, respectively. This is because the different angles of orientation $\alpha_a$ and $\alpha_b$ of the working sections 375*a* and 375*b*, respectively, do not affect the number of drops which are detected in a given sequence providing that the drops of that sequence are directed with no directional errors in the media feed direction 350; i.e. are correctly positioned along their correct dot row.

Figure 11B:
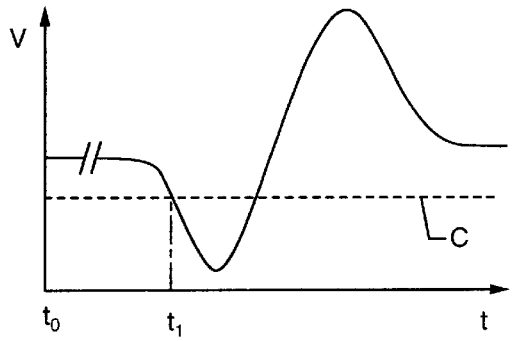
Figure 12A:
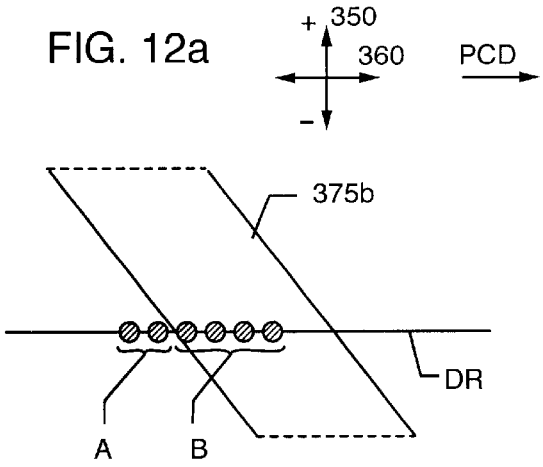
Figure 12B:
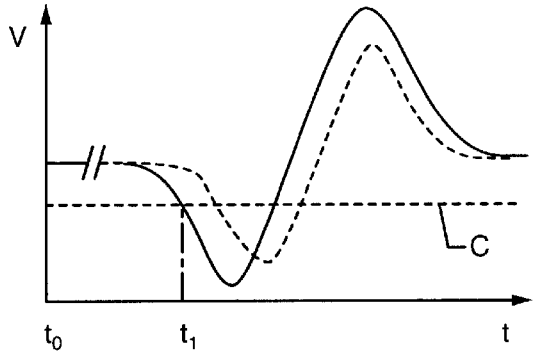
Figure 13A:
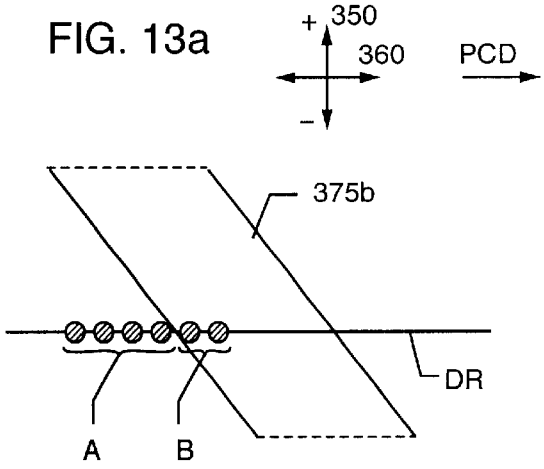
Figure 13B:
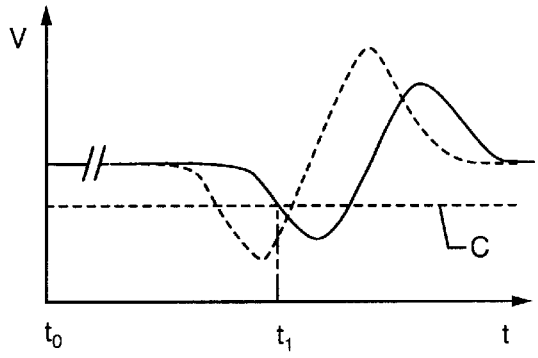

Therefore, in each case the signal output by the photo diode detector 560 of drop detector unit 370*b*, shown in FIG. 11*b*, 12*b* and 13*b*, matches the corresponding output by the photo diode detector 560 of drop detector unit 370*a*, shown in FIGS. 6*b*, 7*b* and 8*b*. As can be seen from the figures, the match between corresponding signals is both in terms of amplitude and time period between the ejection of the drops and the resultant detection signal; i.e. the time period $(t_1-t_0)$.

Therefore, the skilled reader will appreciate that when a nozzle which ejects drops with no drop placement error in the media feed direction 350 is tested as described above, the drop detector units 370*a* and 370*b* will generate equal detection signals both in terms of signal advance or delay and amplitude. The skilled reader will also appreciate that this will be the case irrespective of whether or not the nozzle under test ejects drops with a drop placement error in the scan axis direction 360.

Figure 14A:
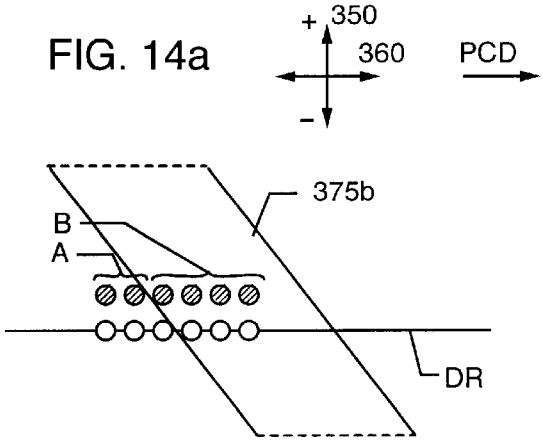

Referring now to FIGS. 14*a* and *b* and 15*a* and *b*, the detection and corresponding output signals for two further sequences of drops are shown. The drops in FIGS. 14 and 15 have the same ejection characteristics as those shown in FIGS. 9 and 10, respectively, as indeed would be the case if they had been ejected by the same nozzles. Thus, the sequence of drops shown in FIG. 14*a* is ejected by a nozzle, which causes a drop placement error in the positive media feed direction 350. The sequence of drops shown in FIG. 15*a* is ejected by a nozzle, which causes a drop placement error in the negative media feed direction 350. In both cases in the same figures, the positions of a series of drops are shown (in outline) which are correctly directed along the desired dot row DR. Thus, as can be seen from the figures the nozzles in both cases have ejected the drops with the correct velocity component in the direction of the scan axis 360.

As can be seen from FIG. 14*a*, due to the angle $\alpha_b$ of the working section 375*b* of the drop detector unit 370*b* relative to the scan axis 320, a drop placement error in the positive media feed direction causes the number of ink drops which pass through the working section 375*b* of the drop detector unit 370*b* to increase. Thus, only the first two drops, referenced "A", to be ejected fall short of the working section 375*b* of the drop detector unit 370*b* and so are not detected. Thus, the remaining four ink drops, referenced "B", pass through the working section 375*b* of the drop detector unit 370*b* and so are detected.

This situation corresponds to the detection of a sequence of drops ejected with a drop placement error in the negative media feed direction when detected by the drop detection unit 370*a*, as is shown in FIG. 10*a*; i.e. the difference in the number of drops detected in FIG. 14*a* relative to that which is normally detected for a correctly directed sequence of drops is opposite to that detected by the drop detection unit 370*a* when detecting a similar sequence of drops with a drop placement error in the positive media feed direction, as shown in FIG. 9*a*.

Figure 14B:
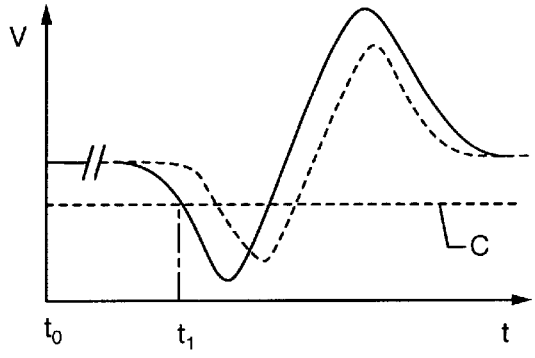
Figure 15A:
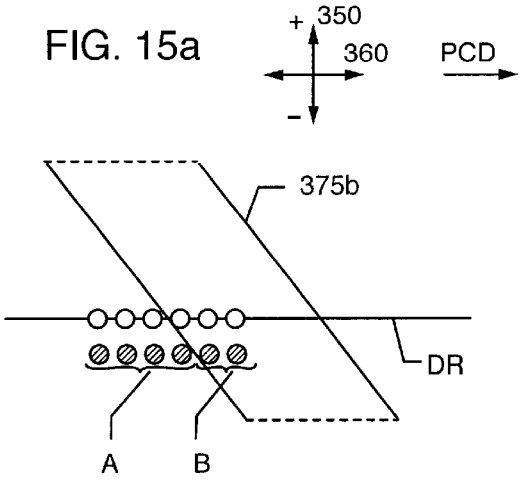

Consequently, the resultant drop detection signal for the situation shown in FIG. 14*a*, shown in FIG. 14*b*, resembles that output by drop detection unit 370*a* when detecting a sequence of drops ejected with a drop placement error in the negative media, as shown in FIG. 10*a*; i.e. the amplitude is increased and the timing is advanced relative to that which would result (shown in dotted line in the same figure) if the ink drops were correctly directed.

As can be seen from FIG. 15*a*, due to the angle $\alpha_b$ of the working section 375*b* of the drop detector unit 370*b* relative to the scan axis 320, a drop placement error in the negative media feed direction causes the number of ink drops which pass through the working section 375*b* of the drop detector unit 370*b* to decrease. Thus, in this case the first four drops, referenced "A", to be ejected fall short of the working section 375*b* of the drop detector unit 370*b* and so are not detected. Thus, only the remaining two ink drops, referenced "B", pass through the working section 375*b* of the drop detector unit 370*b* and so are detected.

Thus, this situation corresponds to the detection of a sequence of drops ejected with a drop placement error in the positive media feed direction when detected by the drop detection unit 370*a*, as shown in FIG. 9*a*. i.e. the difference in the number of drops detected in FIG. 15*a* relative to that which is normally detected for a correctly directed sequence of drops is opposite to that detected by the drop detection unit 370*a* when detecting a similar sequence of drops with a drop placement error in the negative media feed direction, as shown in FIG. 10*a*.

Figure 15B:
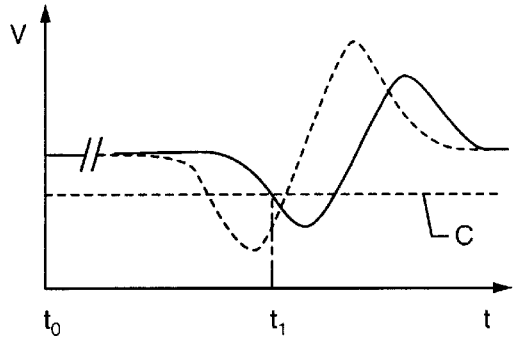

Consequently, the resultant drop detection signal for the situation shown in FIG. 15*a*, shown in FIG. 15*b*, resembles that output by drop detection unit 370*a* when detecting a sequence of drops ejected with a drop placement error in the positive media; i.e. the amplitude is decreased and the timing is retarded relative to that which would result (shown in dotted line in the same figure) if the ink drops were correctly directed.

Therefore, the skilled reader will appreciate that when a nozzle, which ejects drops with a drop placement error in the media feed direction 350, is tested, the media feed direction error component causes the detection signals generated by the detector units 370*a* and 370*b* to differ in equal and opposite ways. The magnitude of the difference between the detection signals, both in terms of their amplitude and their timing delay, is proportional to the degree of misdirection that the nozzle imparts to the drops in the media feed direction 350.

Thus, if the nozzle under test exhibits no drop placement error in the scan axis direction 360, the average value for the detection signals output by the drop detector units 370*a* and 370*b*, both in terms of their amplitude and their timing delay, will be equal to that expected for a nozzle that imparts no directional errors to drops.

Furthermore, in the case of a nozzle that ejects drops with error components in both the media feed direction 350 and in the scan axis direction 360, the difference between the detection signals output by the drop detector units 370*a* and 370*b*, both in terms of their amplitude and their timing delay, will be proportional to the degree of misdirection that the nozzle imparts to drops in the media feed direction 350. Additionally, the average value of the detection signals output by the drop detector units 370*a* and 370*b*, both in terms of their amplitude and their timing delay, will be proportional to the degree of misdirection that the nozzle imparts to drops in the scan axis direction 350.

The process by which the direction of drop ejection of a given nozzle is determined according to the present embodiment will now be described.

In this embodiment, the determination of nozzle ejection direction and correct functioning relies upon the fact that different nozzle ejection directions cause an advance or delay in the detection signal, as has been discussed above.

In this embodiment, the time period between ejecting the first ink drop in a sequence of ink drops and the moment of detecting the subsequent signal is the measurement criterion used; i.e. the period ($t_1$–$t_0$) illustrated in FIGS. 6*b*–15*b*.

When testing a family of nozzles in the present embodiment, each of the nozzles is arranged to be tested in a predetermined order. In this manner, each drop detector unit 370 outputs voltage trace consisting of a sequence of detection signals, as illustrated in FIGS. 6–15, as the print head 310 passes over it. Each signal in the output corresponds to the "test result" for a known nozzle in the family. Furthermore, for each nozzle, the time $t_0$ at which the first ink drop in its ejection sequence is ejected is known. Additionally, the moment of detecting the corresponding signal $t_1$ may be measured from the output.

The temporal position of each test result may then be compared with that which is expected for a correctly working nozzle. Thus, difference between the period ($t_1$–$t_0$) for a correctly working nozzle and each nozzle under test may be easily calculated in the case of both of the drop detector units 370*a* and 370*b*. This information is then used in order to determine whether or not the nozzle in question is functioning correctly and its ejection direction.

Referring now to FIGS. 16–19, the results of testing four separate families of four nozzles in the manner described above are illustrated. The skilled reader will of course appreciate that in practice, the same principle may be applied to testing families of nozzles which are smaller or larger than four.

Each of FIGS. 16–19, illustrate schematically the output traces of voltage against time, generated by the drop detector units 370*a* and 370*b* in testing a different family of nozzles 1–4. The output trace in each figure generated by drop detector unit 370*a* is labeled "a" and the output trace in each figure generated by drop detector unit 370*b* is labeled "b".

For the sake of clarity, in each of these figures the full voltage traces output by the drop detector units 370*a* and 370*b* are not shown but merely the moment $t_1$ of detecting the signal for each nozzle, which in each case is marked by an "X" located along the time axis. Each moment $t_1$ in the output trace generated by drop detector unit 370*a* is labeled $t_{a1}$–$t_{a4}$ in respect of nozzles 1–4 in each family. Similarly, each moment $t_1$ in the output trace generated by drop detector unit 370*b* is labeled $t_{b1}$–$t_{b4}$ in respect of nozzles 1–4 in each family.

The skilled reader will realise that due to the order in which the nozzles of the family pass over the differently orientated working sections 375 of the drop detector units 370, the order in which the nozzles of the family of nozzles are tested by drop detector unit 370*a* will be the reverse of that of drop detector units 370*b*. However, for the sake of clarity, the detection signals have been represented in the same order in each of the figures.

Also shown in each of the figures are the times at which each nozzle would be detected if it were operating correctly, which may be established by measurement. These times are illustrated by vertical dashed lines labeled $T_{a1}$–$T_{a4}$ in respect of nozzles 1–4, respectively, in the case of the output trace "a" in each of the figures; and, $T_{b1}$–$T_{b4}$ in respect of nozzles 1–4, respectively, in the case of the output trace "b" in each of the figures.

Figure 16:
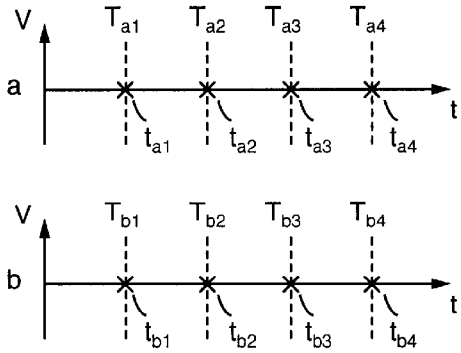
FIGS. 16–19 each schematically illustrate the output voltage trace of a drop detection unit when detecting a series of ink drops ejected by a family of nozzles in an embodiment of the present invention.

As can be seen from FIG. 16, the detection times $t_{a1}$–$t_{a4}$, $t_{b1}$–$t_{b4}$ for each nozzle 1–4 in each of traces "a" and "b" coincide exactly with the corresponding times expected for correctly directed nozzles $T_{a1}$–$T_{a4}$, $T_{b1}$–$T_{b4}$. Thus, the detection times $t_{a1}$–$t_{a4}$, $t_{b1}$–$t_{b4}$ for each nozzle 1–4, as detected by both drop detector unit 370*a* and drop detector unit 370*b*, are neither delayed or advanced. Therefore, it can be concluded that each nozzle in this nozzle family ejects ink drops in the correct direction; i.e. without a drop placement error in either the media feed direction 350 or the scan axis direction 360.

Figure 17:
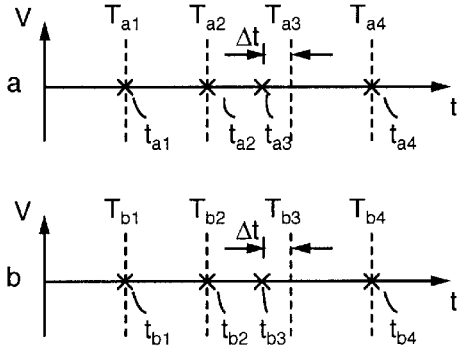

Referring now to FIG. 17, similar traces output by drop detector units 370*a* and 370*b* are shown for a second family of four nozzles.

In this case, the time traces "a" and "b" show that the detection times $t_{a1}$, $t_{a2}$, $t_{a4}$, $t_{b1}$, $t_{b2}$ and $t_{b4}$ coincide with the known time period for a correctly directed nozzles in their respective positions in the family order (i.e. $T_{a1}$, $T_{a2}$, $T_{a4}$, $T_{b1}$, $T_{b2}$ and $T_{b4}$, respectively). Therefore, it can be concluded that nozzles 1, 2 and 4 in the second nozzle family eject ink drops in the correct direction. However, detection times $t_{a3}$ and $t_{b3}$ of the third nozzle 3 are advanced compared to the correct time $T_{a3}$, $T_{b3}$, in the case of both time trace "a" and "b". As is shown in the figure, the time difference At between the measured detection time and the correct detection time is the same both time trace "a" and "b". Therefore, it can be concluded that nozzle 3 is ejecting drops a drop placement error in the scan axis direction 360 but with no drop placement error in the media feed direction 350.

Since the measured timing, $t_{a3}$ and $t_{b3}$, is advanced compared to the correct timing, $T_{a3}$ and $T_{b3}$, the drop placement error is in the direction of movement of the print carriage in the scan axis direction 360. However, if the measured timing, $t_{a3}$ and $t_{b3}$, of this nozzle were delayed compared to the correct timing, $T_{a3}$ and $T_{b3}$, it would be concluded that the drop placement error is in the opposite direction to the movement of the print carriage in the scan axis direction 360.

Figure 18:
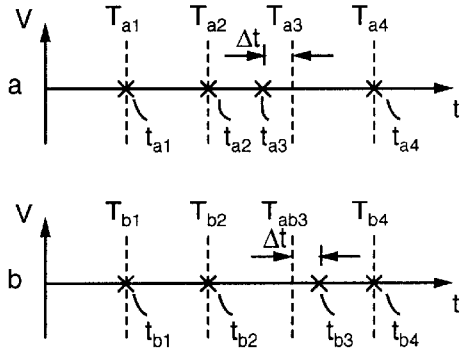

Referring now to FIG. 18, similar time traces output by drop detector units 370*a* and 370*b* are shown for a third family of four nozzles. Again, the measured detection times $t_{a1}$, $t_{a2}$, $t_{a4}$, $t_{b1}$ $t_{b2}$ and $t_{b4}$ coincide with the correct times $T_{a1}$, $T_{a2}$, $T_{a4}$, $T_{b1}$, $T_{b2}$ and $T_{b4}$, indicating that the nozzles 1, 2 and 4 are functioning correctly and are correctly directed.

However, in this case, the detection time, $t_{a3}$, of nozzle 3 in time trace "a" is advanced by Δt relative to the correct time, $T_{a3}$. Furthermore, the detection time, $t_{b3}$, of nozzle 3 in time trace "b" is delayed by Δt relative to the correct time, $T_{b3}$.

Therefore, it can be concluded that the nozzle in question is ejecting drops with a drop placement error in the media feed direction 350. This is because the detection time, $t_{a3}$, in time trace "a" is advanced whilst detection time, $t_{b3}$, is delayed, as has been explained above. The magnitude of the drop placement error in the media feed direction 350 is proportional to the period Δt, as explained above.

Because the output for this nozzle was advanced in the case of the drop detector unit 370*a* and delayed in the case of the drop detector unit 370*b*, it is clear that the drop placement error in the media feed direction 350 is in the positive direction as shown in FIG. 3. If, on the other hand, the output was advanced in the case of the drop detector unit 370*b* and delayed in the case of the drop detector unit 370*a*, it would be clear that the drop placement error in the media feed direction 350 was in the negative direction as shown in FIG. 3.

It can be also be concluded that the nozzle in question is ejecting drops with no drop placement error in the scan axis direction 360. This is because the period, Δt, by which the detection time, $t_{a3}$, in time trace "a" is advanced equals the period by which the detection time, $t_{b3}$, is delayed.

Figure 19:
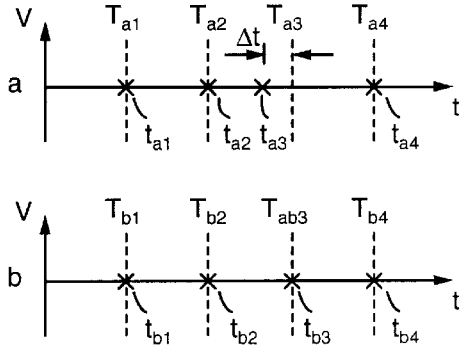

Referring finally to FIG. 19, similar time traces output by drop detector units 370*a* and 370*b* are shown for a further family of four nozzles. Again, the measured detection times $t_{a1}$, $t_{a2}$, $t_{a4}$, $t_{b1}$ $t_{b2}$ and $t_{b4}$ coincide with the correct times $T_{a1}$, $T_{a2}$, $T_{a4}$, $T_{b1}$, $T_{b2}$ and $T_{b4}$, indicating that the nozzles 1, 2 and 4 are functioning correctly and are correctly directed.

However, in this case, the detection time, $t_{a3}$, of nozzle 3 in time trace "a" is advanced by Δt relative to the correct time, $T_{a3}$, and the detection time, $t_{b3}$, of nozzle 3 in time trace "b" is correct relative to the correct time, $T_{b3}$.

In this case it can be concluded that the nozzle in question is ejecting drops with a drop placement error both the media feed direction 350 and in the scan axis direction 360.

Errors in the scan axis direction cause the outputs of the two drop detectors to diverge from the outputs for correctly directed droplets in the same way, as is made clear in FIGS. 6 to 15. Conversely, errors in the media axis direction cause the outputs of the two drop detectors to diverge from the outputs for correctly directed droplets in opposing ways.

Therefore, it is clear in the case of FIG. 19 that there is a drop placement error in the media feed direction 350. This is because the detection time, $t_{a3}$ is offset from the correct time, $T_{a3}$, by a different period (Δt) to the period (zero) by which the detection time, $t_{b3}$ is offset from the correct time, $T_{b3}$. The magnitude of the drop placement error in the media feed direction 350 is proportional to half of the difference between the two timing offsets; i.e. $((t_{a3}-T_{a3})-(t_{b3}-T_{b3}))/2$. In the case of FIG. 19 the drop placement error in the media feed direction is proportional to Δt/2.

In this case, the drop placement error in the media feed direction 350 is in the negative direction as shown in FIGS. 6–15. This is because the detection time $t_{a3}$ is advanced relative to the detection time $t_{b3}$; as is shown in FIGS. 10 and 15. If, however, the detection time $t_{a3}$ were delayed relative to the detection time $t_{b3}$ (as is shown in FIGS. 9 and 14), it would be concluded that the drop placement error in the media feed direction 350 were in the positive direction as shown in FIGS. 6–15.

It is also clear that there is also a drop placement error in the scan axis direction 360. This is because the outputs $t_{a3}$ and $t_{b3}$ of the two drop detectors have not diverged from the correct times $T_{a3}$ and $T_{b3}$ in a symmetrical and opposing way, as would be the case if the nozzle in question ejected droplets with a drop placement error in only the media axis direction.

The magnitude of the drop placement error in the scan axis direction 360 is therefore proportional to the difference between the value of $t_{a3}$ or $t_{b3}$ as shown in the case of FIG. 19 and the value that it would have in the event that the nozzle in question were to eject drops with the same drop placement error in the media axis as shown in FIG. 19 but no drop placement error in the scan axis; i.e. $((t_{a3}-T_{a3})+(t_{b3}-T_{b3}))/2$. In the case of FIG. 19 the drop placement error in the scan axis is proportional to Δt/2.

The direction of the drop placement error in the scan axis direction 360 is therefore in positive scan axis 360 as shown in FIGS. 6 to 15. This is because the drop placement error in the scan axis direction causes the outputs $t_{a3}$ and $t_{b3}$ to be advanced in relation to the correct times $T_{a3}$ and $T_{b3}$.

It will thus be apparent to the skilled reader that by comparing the detection signals output generated by drop detector units 370*a* and 370*b* for a given nozzle, using the system and method of the present embodiment is possible to detect the magnitude of drop placement errors in both the scan axis direction and the media feed direction as well as and combinations of the two. Furthermore, it is possible to distinguish between drop placement errors in both the positive and negative directions of both scan axis direction and the media feed direction.

Once the signal delay or advance has been established in both the scan axis direction and the media feed direction, these values may be compared with values held in a look up table equating values of drop placement errors in both the scan axis direction and the media feed direction with actual drop placement error distances with respect to the print medium. A nozzle is then deemed to be functioning correctly if the drop placement error in neither the scan axis direction nor the media feed direction exceeds corresponding preset thresholds. In the event that either one or both thresholds are exceeded, a maintenance routine may be implemented for that nozzle or its use may be avoided until it functioning has been rectified.

The skilled reader will appreciate that in practice, there is no requirement to translate the signal delay or advance measurements into actual drop placement error distances with respect to the print medium. Instead, the drop placement error thresholds may be defined directly in terms of the signal delay or advance timings.

The thresholds may be set in a number of ways. For instance, the drop placement error of ink dots printed on a print medium may be manually measured, in both the scan axis direction and the media feed direction, and compared with the delay or advance in the signal measurements taken using for the nozzle in question using the system and method described above. Alternatively, the drop placement error may be calculated, in both the scan axis direction and the media feed direction, using a knowledge of the physical relationship of the nozzle in question, the print medium and the drop detector.

Further Embodiments

In the embodiment described above, numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, the embodiment described above is based upon a printer device having one printhead comprising a plurality of nozzles, each nozzle of the printhead being configured to eject a stream of drops of ink. Furthermore, printing on a print medium is performed by moving the print head in mutually orthogonal directions in between print operations, as described above. However, it will be understood by those skilled in the art that general methods disclosed and identified in the claims herein, are not limited to printer devices having a plurality of nozzles or printer devices with a moving print head.

Furthermore, although only one printhead is described in the above embodiment, the skilled reader will appreciate that the present invention may be used to advantage in the printer devices incorporating more than one printhead.

The skilled reader will also appreciate that the frequency of testing nozzles according to the present embodiment may be varied to suit operational needs and constraints. However, increased tests on the functioning of nozzles enables more accurate functioning of a set of servicing algorithms via the printer device. The servicing algorithms are sets of instructions performed before printing a page, during printing and after a page has been printed and are designed to maintain correct operation of the nozzles comprising the print head. Improved servicing of the nozzles results in an increased operating lifetime of the print head.

However, in one embodiment of the invention a test routine may be implemented that tests that some or all of the nozzles of one or more printheads are functioning correctly before printing every page or print job. In such an embodiment, the printhead(s) are arranged to traverse the drop detector units in order that the nozzles may be tested in the manner described above. However, in this embodiment, it is not required that the printheads print an image on the print media as they pass between the drop detector units.

If one or more nozzles are found to be functioning incorrectly, servicing routines may be implemented prior to printing an image to correct the defect. If, the nozzles are found not to be firing correctly, due to a blockage of dry ink, for example, a "spitting" routine may be implemented in an attempt to dislodge the dried ink and allow the nozzle to continue functioning correctly. Once the "spitting" routine is completed the nozzle concerned may be re-tested in accordance with the present invention, as is described above, to determine whether the servicing routine has been successful in correcting the malfunctioning of the nozzles concerned.

In the event that all nozzles are subsequently found to be functioning correctly, the image may be printed in the normal manner. If, on the other hand, one or more nozzles are found still to be functioning incorrectly, those nozzles may be deselected and so not used in a subsequent printing operation. Thus, the print mode which will be used to print the image may be designed so as to avoid printing with those particular nozzles, by assigning the workload that would normally be undertaken by those nozzles to other, or replacement nozzles. Such techniques are known as "error hiding". Examples of error hiding techniques suitable for use in combination with the present invention are disclosed in European Patent Applications 99103283.0 and 98301559.5, both in the name of Hewlett-Packard Co and which are hereby incorporated by reference.

Furthermore, where the drop placement error of a given nozzle is such that it prints drops on locations that are normally printed on by further nozzles, the given nozzles may be used to partly or exclusively in place or the further nozzles.

In certain circumstances, it may be desirable to test given nozzles more than once in order to gain a more accurate knowledge of the manner in which a nozzles is misfunctioning as a more accurate knowledge improves the operation of any error hiding print modes performed by the printer device.

The skilled reader will realise that using the system of the present invention, it is in fact only necessary to measure the differences between signals, either in terms of amplitude or signal timing, which are generated for a series or family of nozzles in order to determine whether or not nozzles are operating in a similar manner; or, alternatively to check that given signals do not fall outside of a preselected statistical range relative to the corresponding signals output for neighbouring nozzles. This is because the exact drop placement of a given nozzle is less important in terms of print output quality than the relative drop placement of a given nozzle relative to the other nozzles.

Thus, using the system of the present invention, it is not necessary to measure the exact performance of any or each nozzle to determine whether a print head is operating correctly, or whether an individual nozzle is operating correctly. Instead, when testing a nozzle family it would be possible to simply measure the temporal separation, for example, between the detection signals of consecutively tested nozzles to determine whether a nozzle has ejection characteristics that differ from the remaining nozzles by an amount that exceeds a predetermined threshold.

Furthermore, the skilled reader will realise that a printer device according to the present invention may be configured to store information regarding the directionality of ejection of individual nozzles and to determine the frequency of use for each nozzle based on the degree of drop placement error that the nozzle exhibits. For example, nozzles which exhibit negligible or no drop placement error may be used at a high level of capacity in carrying out a print job and nozzles which exhibit increasing levels of drop placement error may be used at a decreasing level of capacity, or only where required. In this manner the print quality of the output print product may be increased.

The skilled reader will also appreciate that various ways in which the drop detection units are located exist. For example, in other embodiments of the present invention, the angles at which the drop detection units are located relative to the scan axis may be varied according to requirements. The skilled reader will appreciate that if the drop detection units are located at a more oblique angle to the scan axis, then a greater number of nozzles may be tested in a single pass. However, by locating the drop detection units at a more oblique angle to the scan axis, the distance that the printer carriage must travel in each pass to fully pass over the drop detection units must increase. This has the effect of increasing the length of time that each pass takes. Therefore, the exact angle at which the drop detection units are located relative to the scan axis may be determined according to requirements in order to optimize these requirements.

Furthermore, although in the above-described embodiment the drop detection units are arranged on either side of the media feed path, in practice both units may be located on the same side of the media feed path. This gives the advantage that the nozzles of a print head may be tested rapidly without having to traverse the entire width of the feed path if they are being tested while the printer is not printing.

Additionally, in a further embodiment of the invention, the optical source of the drop detection units, for example a laser, could be located over the over the media path itself. This allows the directionality of the nozzles to be tested whilst the nozzles are printing an image; thus obviating the need for wasting ink and time in testing the nozzles whilst the printer is not printing.

What is claimed is:

1. An ink jet apparatus comprising a nozzle arranged to eject ink droplets and an edge detector arranged to detect droplets having a first range of trajectories and arranged not to detect droplets having a second range of trajectories, said nozzle being arranged to eject one or more first droplets from each of a plurality of positions known relative to said edge detector, said positions being arranged such that said number of first droplets detected by said edge detector varies in dependence upon the magnitude of a component of the ejection direction of said nozzle, said apparatus being arranged to substantially determine a component of said ejection direction of said nozzle in dependence upon said detection by said edge detector.

2. An apparatus according to claim 1, further comprising a print media feed path, said nozzle being arranged to traverse said media path and said edge detector along a scan axis arranged substantially perpendicularly to said media path.

3. An apparatus according to claim 2, further arranged to incrementally print an image on a print medium in a plurality of printing passes over said media path by ejecting ink drops from said nozzle, said component of ejection direction of said nozzle being determined between starting and finishing printing said image.

4. An apparatus according to claim 3, further arranged to eject said first droplets in between consecutive printing passes or during a given printing pass.

5. An apparatus according to claim 4, further arranged to modify said usage of said nozzle in one or more of said plurality of printing passes subsequent to ejecting said first droplets in dependence upon said determined component of ejection direction.

6. An apparatus according to claim 1, further comprising a second edge detector arranged to detect second droplets ejected by said nozzle as defined in claim 1, said apparatus being arranged to substantially determine a second component of said ejection direction of said nozzle independence upon said detection by said second edge detector.

7. An apparatus according to claim 6, wherein said first edge detector is orientated at a positive angle to said scan axis and said second edge detector is orientated at a negative angle to said scan axis.

8. An apparatus according to claim 7, wherein said first and/or second edge detector is located laterally offset from said media path.

9. An apparatus according to claim 6, wherein said nozzle forms part of a print head comprising a plurality of nozzles, said first or second edge detector and said print head being arranged such that different nozzles of said print head traverse said edge detector at different times.

10. An apparatus according to claim 9, wherein said apparatus is arranged to substantially determine a component of said ejection direction of a plurality of nozzles of said printhead as defined in claim 1 in one pass of said first or second edge detector.

11. An apparatus according to claim 6, wherein said first or second edge detector comprises an optical sensor arranged to output a signal corresponding to said number of ink droplets located between said optical sensor and a light source.

12. An apparatus according to claim 1, wherein said apparatus is arranged to determine a first nozzle position at which ejected droplets are substantially detected and to determine a second nozzle position at which ejected droplets are substantially not detected, said apparatus being further arranged to determine a third nozzle position substantially between said first and second positions at which ejected droplets are substantially detected, said apparatus being arranged to determine a magnitude of a component of said direction of ejection of said ink droplets ejected by said nozzle on said basis of said third position.

13. A direction determining apparatus comprising a nozzle arranged to eject drops of liquid and a drop detection device having a detection zone, said detection zone having a border defining the limit of said detection zone in a first direction, said nozzle being arranged to move relative to said drop detection zone and being further arranged to eject a series of drops from substantially known positions, such that at least one of said drops passes on a first side of said border through said detection zone and at least one of said drops passes on a second side of said border, said device being arranged to determine a component of said direction of drop ejection in dependence upon said proportion of said drops that pass through said detection zone.

14. A method of determining said ink drop ejection direction of an ink ejection nozzle of an ink jet device, said device comprising a drop detector being arranged to detect drops in a first range of positions and arranged not to detect droplets in a second range of positions, said method comprising said steps of:

ejecting one or more drops from each of a plurality of positions known relative to said edge detector, said positions being arranged such that said number of drops detected by said edge detector varies in dependence upon said magnitude of a component of said ejection direction of said nozzle;

detecting said drops passing through said first range of positions; and, determining a component of said direction of ejection of said nozzle in dependence upon said detected drops.

15. A method according to claim 14, wherein said step of ejecting is carried out whilst said nozzle moves at a constant velocity along a nozzle path either towards or away from said edge detector.

16. A method according to claim 15, wherein said plurality of positions are substantially equally spaced along said nozzle path.

17. A method according to claim 16, wherein said drop detector is arranged to detect said number of drops simultaneously present in said first range of positions.

18. A method according to claim 17, wherein said step of detecting further comprises said step of generating a detection signal corresponding to said detected number of said drops and said step of determining further comprises comparing an attribute of said detection signal with a predetermined threshold or value.

19. A method according to claim 18, wherein said nozzle forms part of a printhead having a plurality of nozzles, said method comprising said steps of repeating each of said steps of ejecting, detecting and determining for each of said plurality of nozzles.

20. A method according to claim 19, further comprising said step of generating a plurality of detection signals corresponding to said plurality of nozzles, said step of determining further comprising said step of comparing an attribute of each of said plurality of detection signals with threshold or value dependent upon said equivalent attribute of one or more of said remainder of said plurality of detection signals.

21. A method according to claim 20, wherein said attribute is said signal amplitude or a function of said detection time.

22. A method according to claim 14, said method comprising said further step of determining a second component of said direction of ejection of said nozzle, said second component being in a different direction to said first component, said further step including said step of repeating each of said steps of ejecting, detecting and determining in respect of a second drop detector, said second drop detector having an orientation different to that of said first.

23. A method of incrementally printing an image on a print medium by ejecting ink drops from one or more nozzles, said method comprising said step of determining a component of said ink drop ejection direction of said one or more nozzles, as defined in claim 14, between starting and finishing printing said image.

24. A method according to claim 23, wherein said image is printed in a series of passes and said step of determining a component of said ink drop ejection direction is carried out between printing consecutive passes.

25. A method according to claim 24, further comprising said step of increasing or decreasing said number of printing operations to be undertaken by a first nozzle in dependence upon said determination step in respect of said first nozzle.

26. A method according to claim 25, further comprising said step of initiating a servicing routine for said first nozzle in dependence upon determination step.

27. A computer program comprising program code means for performing said method steps of claim 14 when said program is run on a computer and/or other processing means associated with suitable drop detection and measurement apparatus.

28. A direction determining apparatus comprising a nozzle arranged to eject drops of liquid from positions along a first axis and an edge detector having an edge located at an angle to said axis arranged to detect drops at a first side of said edge but not at a second side of said edge, said nozzle being arranged to eject drops from a plurality of positions known relative to said edge such that at least one drop passes on either side of said edge, the apparatus being further arranged to determine the proportion of drops passing on said first side of said edge and to compare said proportion with the proportion expected for a nozzle with no directional error and being further arranged to determine an error component in the direction of ejection perpendicular to said axis in dependence upon the comparison.

29. In an inkjet device comprising an ink ejection nozzle arranged to traverse a print area along a scan axis and further comprising an edge detector having an edge located at an angle to said scan axis being arranged to detect ink drops at a first side of said edge but not at a second side of said edge, a method of determining an error in the component direction of ink ejection perpendicular to said scan axis, comprising said steps of:

ejecting one or more drops from each of a plurality of positions known relative to said edge, such that at least one drop passes on either side of said edge;

determining said proportion of drops passing to said first side of said edge;

comparing said determined proportion with said proportion expected for a nozzle with no directional error; and, determining the magnitude of said error in dependence upon said compared value.

30. A method of determining said direction of ejection of an ink drop ejected from an ink ejection nozzle of an inkjet device, said nozzle being arranged to traverse a print area along a scan axis, said device comprising first and second edge detectors having respective edges arranged at differing angles to said scan axis and each arranged to detect drops in respective first ranges of positions and arranged not to detect drops in respective second range of positions, said method comprising the steps of:

ejecting one or more drops from each of a plurality of positions known relative to said first edge detector, said positions being arranged such that said number of drops detected by said edge detector varies in dependence upon said magnitude of a first component of said ejection direction of said nozzle;

detecting said drops passing through said first range of positions; and, determining a component of said direction of ejection of said nozzle in dependence upon said detected drops; and, repeating said steps of ejecting, detecting and determining in respect of said second edge detector to determine a second component of said direction of ejection of said nozzle.

* * * * *

UNITED STATES PATENT AND TRADEMARK OFFICE

CERTIFICATE OF CORRECTION

PATENT NO. : 6,582,051 B2
DATED : June 24, 2003
INVENTOR(S) : Xavier Bruch et al.

It is certified that error appears in the above-identified patent and that said Letters Patent is hereby corrected as shown below:

Column 24,
Line 7, change “independence” to -- in dependence --.

Column 26,
Line 53, change “positions; and,” to -- positions; --.

Signed and Sealed this

Twentieth Day of September, 2005

JON W. DUDAS
*Director of the United States Patent and Trademark Office*